US011549261B2

(12) United States Patent
Shimatani

(10) Patent No.: US 11,549,261 B2
(45) **Date of Patent: *Jan. 10, 2023**

(54) BUILDING MATERIAL, STACKED BODY OF BUILDING MATERIALS, AND BUILDING-MATERIAL CONSTRUCTION METHOD

(71) Applicant: NICHIHA CORPORATION, Nagoya (JP)

(72) Inventor: Yasuhiko Shimatani, Nagoya (JP)

(73) Assignee: NICHIHA CORPORATION, Nagoya (JP)

( * ) Notice: Subject to any disclaimer, the term of this patent is extended or adjusted under 35 U.S.C. 154(b) by 630 days.

This patent is subject to a terminal disclaimer.

(21) Appl. No.: 16/337,843

(22) PCT Filed: Jan. 25, 2018

(86) PCT No.: PCT/JP2018/002204

§ 371 (c)(1),
(2) Date: Mar. 28, 2019

(87) PCT Pub. No.: WO2018/139509

PCT Pub. Date: Aug. 2, 2018

(65) Prior Publication Data

US 2020/0040573 A1 Feb. 6, 2020

(30) Foreign Application Priority Data

Jan. 27, 2017 (JP) ..... JP2017-012640

(51) Int. Cl.
*E04C 2/30* (2006.01)
*E04B 2/56* (2006.01)
(Continued)

(52) U.S. Cl.
CPC ..... *E04C 2/30* (2013.01); *B65D 57/003* (2020.05); *E04B 2/56* (2013.01);
(Continued)

(58) Field of Classification Search
CPC ..... E04C 2/30; E04C 2002/3461; E04B 2/56; E04F 13/08; E04F 2201/0138; E04F 2201/07; B65D 57/003
See application file for complete search history.

(56) References Cited

U.S. PATENT DOCUMENTS 8,281,535 B2 10/2012 Chen et al.
10,800,139 B2 * 10/2020 Shimatani ..... E04F 13/08
(Continued)

FOREIGN PATENT DOCUMENTS

CN 104471175 A 3/2015
JP 49-30420 A 3/1974
(Continued)

OTHER PUBLICATIONS

Taiwanese Office Action and Search Report issued in the corresponding Taiwanese Patent Application No. 107102840 dated May 25, 2021.

(Continued)

*Primary Examiner* — Beth A Stephan
(74) *Attorney, Agent, or Firm* — Birch, Stewart, Kolasch & Birch, LLP

(57) ABSTRACT

[Object] To provide a building material, a stacked body of building materials, and a building-material construction method capable of improving the construction properties while suppressing a design surface from being damaged.
[Solution] A building material includes a substantially rectangular plate-shaped building material body 2 that includes a first face 2F and a design surface 3 within the first face 2F; and a protective sheet S1 that is affixed to the building
(Continued)

material body 2 in a peelable manner. The design surface 3 includes a covered region C1 that is covered with the protective sheet S1 and thereby protected and an exposed region B1 that is not covered with the protective sheet S1 and that extends along a first design end portion 3D, which is an end portion of the design surface 3.

7 Claims, 12 Drawing Sheets

(51) Int. Cl.
*B65D 57/00* (2006.01)
*E04C 2/34* (2006.01)
*E04F 13/08* (2006.01)

(52) U.S. Cl.
CPC ..... *E04C 2002/3461* (2013.01); *E04F 13/08* (2013.01); *E04F 2201/0138* (2013.01); *E04F 2201/07* (2013.01)

(56) References Cited

U.S. PATENT DOCUMENTS

| | | | |
|---|---|---|---|
| 2004/0086676 | A1 | 5/2004 | Peng |
| 2007/0044409 | A1 | 3/2007 | Anderson |
| 2007/0196611 | A1 | 8/2007 | Chen et al. |
| 2012/0240502 | A1 | 9/2012 | Wilson et al. |
| 2015/0044409 | A1 | 2/2015 | Ko et al. |
| 2016/0332920 | A1 | 11/2016 | Watanabe |
| 2017/0145569 | A1 | 5/2017 | Hara et al. |
| 2018/0128944 | A1 | 5/2018 | Miyazaki et al. |

FOREIGN PATENT DOCUMENTS

| | | | |
|---|---|---|---|
| JP | 6-193240 | A | 7/1994 |
| JP | 11-50591 | A | 2/1999 |
| JP | 2866369 | B1 | 3/1999 |
| JP | 11-270140 | A | 10/1999 |
| JP | 2005-532932 | A | 11/2005 |
| JP | 2006-104874 | A | 4/2006 |
| JP | 2010-58846 | A | 3/2010 |
| JP | WO2010/067787 | A1 | 6/2010 |
| JP | 2013-40443 | A | 2/2013 |
| JP | 2013-163764 | A | 8/2013 |
| JP | 2014-100884 | A | 6/2014 |
| JP | WO2014/208564 | A1 | 12/2014 |
| JP | 2015-174694 | A | 10/2015 |
| JP | 2016-5884 | A | 1/2016 |
| JP | 2016-188492 | A | 11/2016 |
| JP | 2017-47351 | A | 3/2017 |
| JP | 1598501 | S | 2/2018 |
| JP | 1598586 | S | 2/2018 |
| JP | 1598587 | S | 2/2018 |

OTHER PUBLICATIONS

Extended European Search Report for European Application No. 18744087.0, dated Jul. 10, 2020.
English translation of the International Search Report, dated Feb. 20, 2018, for International Application No. PCT/JP2018/002204.
Japanese Office Action, dated Jun. 29, 2021, for Japanese Application No. 2017-012640, with an English machine translation.
Applicant Response, dated Apr. 20, 2022, to Australian Office Action for Australian Application No. 2018212045.
Applicant Response, dated Apr. 29, 2022, to Australian Office Action for Australian Application No. 2018212045.
Applicant Response, dated Dec. 10, 2021, to Chinese Office Action for Chinese Application No. 201880003682.8.
Applicant Response, dated Jul. 21, 2021, to Chinese Office Action for Chinese Application No. 201880003682.8.
Applicant Response, dated Mar. 22, 2021, to Chinese Office Action for Chinese Application No. 201880003682.8.
Australian Notice of Acceptance for Australian Application No. 2018212045, dated May 12, 2022.
Australian Office Action for Australian Application No. 2018212045, dated Apr. 27, 2022.
Australian Office Action for Australian Application No. 2018212045, dated Aug. 23, 2021.
Chinese Notice of Allowance and English Translation for Chinese Application No. 201880003682.8, dated Jan. 30, 2022.
Chinese Office Action and English translation for Chinese Application No. 201880003682.8, dated May 7, 2021.
Chinese Office Action and English translation for Chinese Application No. 201880003682.8, dated Sep. 24, 2020.
Chinese Office Action and English translation for Chinese Application No. 201880003682.8, dated Sep. 27, 2021.

* cited by examiner

BUILDING MATERIAL, STACKED BODY OF BUILDING MATERIALS, AND BUILDING-MATERIAL CONSTRUCTION METHOD

TECHNICAL FIELD

The present invention relates to a building material, a stacked body of building materials, and a building-material construction method.

BACKGROUND ART

Examples of existing building materials are disclosed in PTLs 1 to 3. These building materials each include a substantially rectangular plate-shaped building material body and a protective sheet that covers a surface of the building material body.

Specifically, PTL 1 describes a feature of disposing a protective sheet as a packing sheet between a pair of the building material bodies disposed such that respective design surfaces that each have a coating, an embossed pattern, and the like face each other, and binding the building material bodies together and describes a feature of loading, on a pallet, the pair of the bound building material bodies between which the protective sheet is disposed. PTL 2 and PTL 3 each describe a feature of affixing a protective sheet to a design surface of a building material body, the design surface being a decorative layer or a finishing layer, in a peelable manner. When protective sheets such as those in PTLs 2 and 3 are used, design surfaces are also suppressed from being damaged during construction.

As described above, in building materials, such as those disclosed in PTLs 1 to 3, covering a surface including end portions of a building material body with a protective sheet to suppress a design surface from being damaged is typically performed. PTL 1 describes using a protective sheet slightly larger than the size of an entire surface of a building material body. In addition, PTL 2 includes an illustration of a form in which a protective sheet is affixed to a surface including end portions of a building material body.

CITATION LIST

Patent Literature

PTL 1: Japanese Unexamined Patent Application Publication No. 2010-58846

PTL 2: Japanese Unexamined Patent Application Publication No. 11-50591

PTL 3: Japanese Unexamined Patent Application Publication (Translation of PCT Application) No. 2005-532932

SUMMARY OF INVENTION

Technical Problem

When construction is performed while a surface of a building material body is covered with a protective sheet to suppress a design surface from being damaged, the existing building materials, such as those described above, including a building material body and a protective sheet require an operation to be performed while paying attention to prevent a sheet end of a protective sheet from being caught between building material bodies adjacent to each other. A sheet end of a protective sheet caught between building material bodies adjacent to each other requires an extra construction labor, for example, extracting a caught portion thereof with attention to prevent breakage thereof. Moreover, sheet ends of building material bodies adjacent to each other, each of the sheet ends serving as a starting point for peeling off a protective sheet, easily overlap each other. Thus, operation of peeling protective sheets may become difficult. As a result, it is difficult for the existing building materials to improve the construction properties while suppressing design surfaces from being damaged.

The present invention was developed in consideration of the aforementioned existing circumstance, and a solution to a problem is to provide a building material, a stacked body of building materials, and a building-material construction method capable of improving construction properties while suppressing designs surfaces from being damaged.

Solution to Problem

A building material according to a first aspect of the present invention includes: a substantially rectangular plate-shaped building material body that includes a first face and a design surface within the first face; and a protective sheet affixed to the building material body in a peelable manner. The design surface includes a covered region that is covered with the protective sheet and thereby protected and an exposed region that is not covered with the protective sheet and that extends along a first design end portion, the first design end portion being an end portion of the design surface.

In the building material according to the first aspect, the covered region of the design surface formed within the first face of the building material body is covered with the peelable protective sheet and thereby protected. Thus, during construction, the design surface is suppressed, by the protective sheet at the covered region, from being damaged.

Meanwhile, the exposed region of the design surface extends along the first design end portion and is not covered with the protective sheet. Thus, during construction, the first design end portion of the design surface of each of the building material bodies adjacent to each other is exposed. In other words, a sheet end of the protective sheet is spaced from the first design end portion thereof, and it is thus possible to suppress the inconvenience of the sheet end of the protective sheet being caught between the building material bodies adjacent to each other in the vicinity of the first design end portion thereof. Thus, it is not necessary to perform operation, in the vicinity of the first design end portion, while paying attention to prevent the sheet end of the protective sheet from being caught between the building material bodies adjacent to each other. Moreover, it is possible to eliminate the extra construction labor, for example, extracting a caught portion of the protective sheet with attention to prevent breakage thereof. Moreover, the sheet ends of the building material bodies adjacent to each other, each of the sheet ends serving as a starting point for peeling off the protective sheet, are also spaced from each other in the vicinity of the first design end portion thereof, which enables easy peeling of the protective sheet.

Consequently, the building material according to the first aspect of the present invention is capable of improving the construction properties while suppressing the design surface from being damaged.

As a second aspect of the present invention, the design surface desirably includes a first design surface that is spaced inward from the first design end portion and a second design surface that connects the first design end portion and the first design surface to each other and that inclines with respect to the first design surface. In addition, the exposed region desirably includes a portion of the second design surface.

According to this configuration, it is possible by using the second design surface, which is a chamfered portion of the first design end portion of the design surface, to suppress the design surface from being damaged not only during construction but also during storage and transport. In addition, due to the exposed region including a portion of the second design surface, the sheet end of the protective sheet is further suppressed from being easily caught between the building material bodies adjacent to each other during construction. As a result, this building material is capable of further improving the construction properties.

As a third aspect of the present invention, in the second aspect, the exposed region and the covered region are desirably formed on the second design surface. In addition, the covered region desirably extends from the first design surface to an intermediate portion of the second design surface.

According to this configuration, due to the second design surface inclining, the sheet end of the protective sheet covering the covered region extending from the first design surface to the intermediate portion of the second design surface is easily peeled off after construction. As a result, this building material is capable of further improving the construction properties.

As a fourth aspect of the present invention, in the third aspect, the protective sheet desirably extends outward, in a non-contact state of being not in contact with the second design surface, from the first design surface. In addition, a sheet end of the protective sheet is desirably located between the first design end portion and the first design surface.

According to this configuration, the sheet end of the protective sheet floats from, inside the first design end portion, the second design surface. Thus, the sheet end of the protective sheet is easily peeled off after construction. In addition, due to the sheet end of the protective sheet not extending outward from the first design end portion, the sheet end of the protective sheet is suppressed from being easily caught between the building material bodies adjacent to each other during construction. As a result, the building material is capable of further improving the construction properties.

As a fifth aspect, the exposed region desirably includes a pair of exposed regions that extend along the first design end portion and a second design end portion opposite to the first design end portion.

According to this configuration, due to the exposed region being formed on each of both end portions of the design surface opposite each other, the sheet end of the protective sheet is further suppressed from being easily caught between the building material bodies adjacent to each other. As a result, the building material is capable of further improving the construction properties.

As a sixth aspect of the present invention, the exposed region desirably extends along the first design end portion and a third design end portion intersecting the first design end portion.

According to this configuration, due to the exposed region being formed on two mutually intersecting end portions of the design surface, the sheet end of the protective sheet is further suppressed from being easily caught between the building material bodies adjacent to each other during construction. As a result, the building material is capable of further improving the construction properties.

As a seventh aspect of the present invention, the exposed region desirably extends along end portions at four sides of the design surface.

According to this configuration, due to the exposed region being formed on the end portions at the four sides of the design surface, the sheet end of the protective sheet is further suppressed from being easily caught between the building material bodies adjacent to each other during construction. As a result, the building material is capable of further improving the construction properties.

As an eighth aspect of the present invention, the building material body desirably includes: a second face facing a side opposite to a side that the first face faces; a first rear-surface-side joining portion that is recessed from a second design end portion opposite to the first design end portion toward the second face and that projects outward on a side of the second face; and a first front-surface-side joining portion that is formed at a portion of the building material body opposite to the first rear-surface-side joining portion and that is joinable to the first rear-surface-side joining portion of another building material body adjacent thereto. In addition, a surface of the first rear-surface-side joining portion on a side of the first face is desirably not covered with the protective sheet. Moreover, the exposed region is desirably formed on a surface of the first front-surface-side joining portion on the side of the first face.

According to this configuration, the surface of the first rear-surface-side joining portion on the side of the first face is joined, in a state of not being covered with the protective sheet, to the first front-surface-side joining portion and concealed during construction. The first design end portion extends on the side of the first face where the first front-surface-side joining portion is present, and the exposed region extends along the first design end portion. Thus, the sheet end of the protective sheet is further suppressed, during construction, from being easily caught at a joint portion between the first front-surface-side joining portion and the first rear-surface-side joining portion of the building material bodies adjacent to each other. As a result, the building material is capable of further improving the construction properties.

As a ninth aspect of the present invention, in the eighth aspect, the building material body desirably includes: a second rear-surface-side joining portion that is recessed from a third design end portion intersecting the first design end portion toward the second face and that projects outward on the side of the second face; and a second front-surface-side joining portion that is formed at a portion of the building material body opposite to the second rear-surface-side joining portion and that is joinable to the second rear-surface-side joining portion of another building material body adjacent thereto. A surface of the second rear-surface-side joining portion on the side of the first face is desirably not covered with the protective sheet. In addition, the exposed region is desirably formed on a surface of the second front-surface-side joining portion on the side of the first face.

According to this configuration, the first design end portion extends on the side of the first face where the first front-surface-side joining portion is present, and the exposed region extends along the first design end portion. In addition, the exposed region is formed on the side of the first face where the second front-surface-side joining portion is present. Thus, the sheet end of the protective sheet is further suppressed, during construction, from being easily caught at the joining portion between the first front-surface-side joining portion and the first rear-surface-side joining portion and at a joint portion between the second front-surface-side joining portion and the second rear-surface-side joining portion of the building material bodies adjacent to each other. As a result, the building material is capable of further improving the construction properties.

A stacked body of building materials according to a tenth aspect of the present invention is a stacked body of building materials, each of the building materials being any one of the building materials described above, the building materials being stacked on each other. A pair of the building materials that are stacked on each other in a state in which the first faces of the building materials are opposite each other constitutes a set. The exposed region of one of the building materials constituting the set is protected by the protective sheet that covers the covered region of another of the building materials constituting the set.

In the stacked body of building materials according to the tenth aspect, the exposed region of one of the building materials is protected by the protective sheet of another of the building materials opposite thereto, and it is thus possible to suppress the design surface from being damaged during storage and during transport.

A building-material construction method according to an eleventh aspect of the present invention includes a first step for fastening any one of the building materials described above to a structure of a building, and a second step for peeling the protective sheet from the design surface after the first step.

In the building-material construction method according to the eleventh aspect, the covered region of the design surface formed within the first face of the building material body is covered with the peelable protective sheet and thereby protected. Thus, the design surface is suppressed by the protective sheet on the covered region from being damaged during the first step in construction.

Meanwhile, the exposed region of the design surface extends along the first design end portion and is not covered with the protective sheet. Thus, during the first step in construction, the first design end portion of the design surface of each of the building material bodies adjacent to each other is exposed. In other words, the sheet end of the protective sheet is spaced from the first design end portion thereof, and it is thus possible to suppress the inconvenience of the sheet end of the protective sheet being caught between the building material bodies adjacent to each other in the vicinity of the first design end portion thereof. Thus, it is not necessary to perform operation while paying attention to prevent the sheet end of the protective sheet from being caught between the building material bodies adjacent to each other in the vicinity of the first design end portion thereof, and it is possible to eliminate the extra construction labor. As describe above, easy peeling of the protective sheet is enabled.

Consequently, the building-material construction method according to the eleventh aspect of the present invention is capable of improving the construction properties while suppressing the design surface from being damaged.

Advantageous Effects of Invention

According to the building material, the stacked body of building materials, and the building-material construction method of the present invention, it is possible to improve the construction properties while suppressing design surfaces from being damaged.

DESCRIPTION OF EMBODIMENTS

Figure 1:
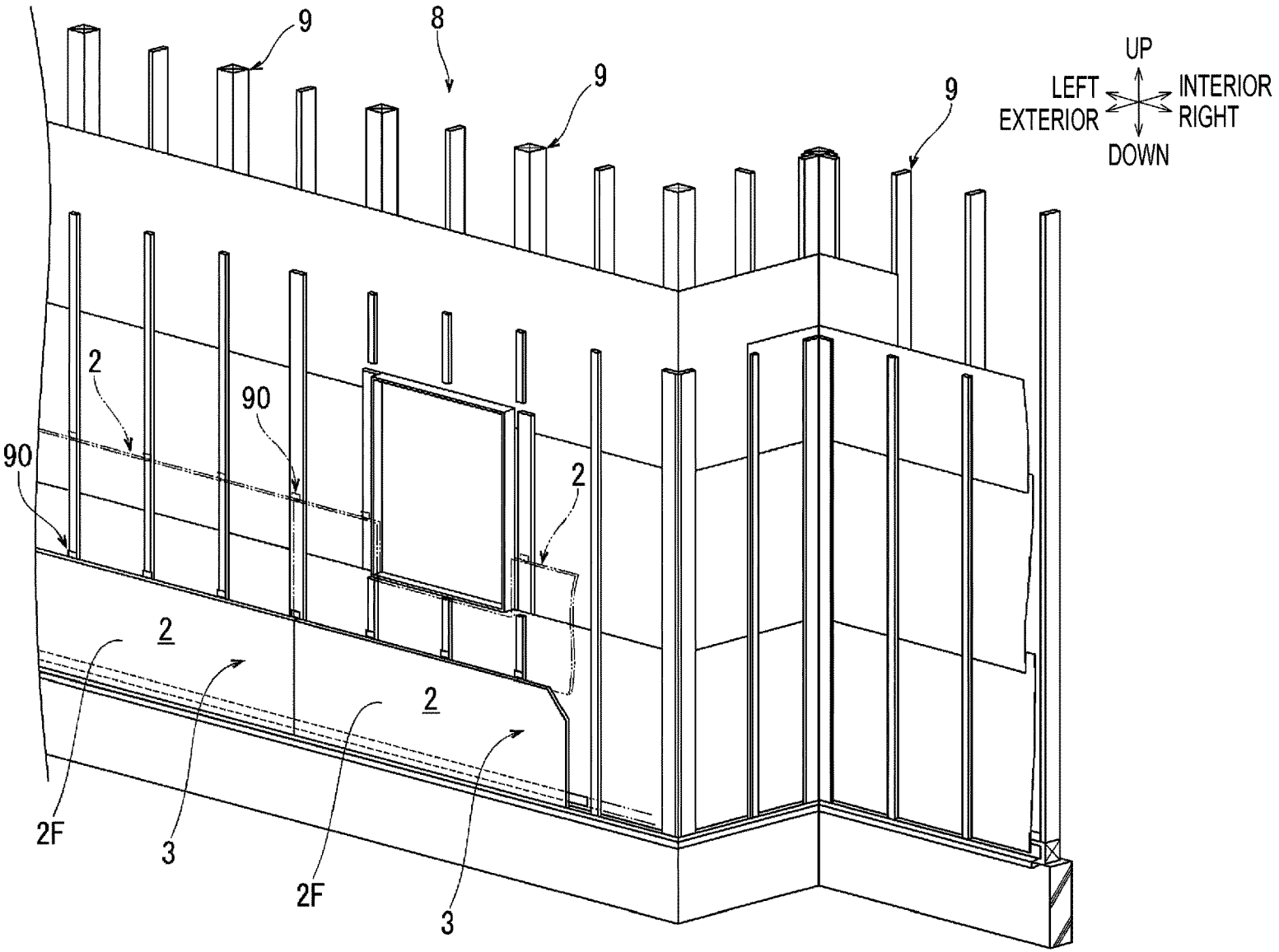
FIG. 1 is a perspective view of an exterior structure of a building, the exterior structure using an exterior wall board according to a first embodiment.

Hereinafter, first to eighth embodiments of the present invention will be described with reference to the drawings. In FIG. 1, the vertically upward direction is indicated as up, and the vertically downward direction is indicated as down. In addition, in a direction from the exterior toward the interior, the horizontally leftward direction is indicated as left, and the horizontally rightward direction is indicated as right. The directions indicated in FIG. 2 and the subsequent figures correspond to the directions in FIG. 1.

First Embodiment

FIG. 1 illustrates a state in which a plurality of exterior wall boards 2 are attached to a structure 8 of a building. As illustrated in FIG. 1, the building is a house, facilities, a warehouse, or the like.

Figure 2:
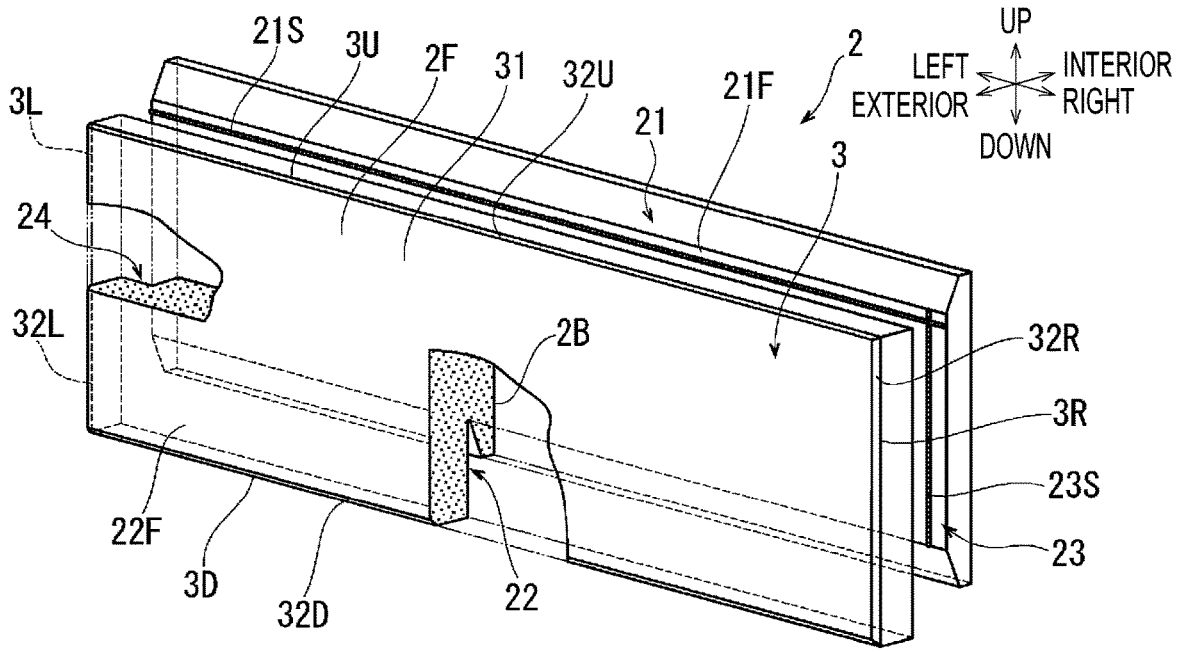
FIG. 2 is a perspective view of the exterior wall board according to the first embodiment.

FIG. 2 illustrates a specific shape of the exterior wall board 2. A building material of the first embodiment illustrated in each of FIG. 3 to FIG. 8 includes the exterior wall board 2 and a protective sheet S1. The exterior wall board 2 is a plate material that has, in itself, high strength and rigidity and that constitutes an exterior wall of a building. The exterior wall board 2 is an example of a "building material body". The building material body is, however, not limited to the exterior wall board and may be an exterior decorative board for a building, an interior structure panel, an interior board, or the like.

In the present embodiment, the structure 8 is built by, for example, timber framing. The structure 8 is constituted by a plurality of structure members. The structure members include members 9, such as a plurality of column materials disposed adjacent to each other in the left-right direction with a predetermined interval therebetween and studs disposed between the column materials.

The structure 8 is, however, not limited to the configuration of the present embodiment and may be built by, for example, framing. In addition, a structure to which the building material body is attached may be, for example, a frame made of steel, reinforced concrete, brick, or the like and may be an interior partition wall.

As illustrated in FIG. 2, the exterior wall board 2 has a quadrilateral shape; more specifically, the exterior wall board 2 is a substantially rectangular plate material that is long in the left-right direction. In the present embodiment, the exterior wall board 2 is made of a cement-containing ceramic material. More specifically, the exterior wall board 2 is a wood cement board. Note that the material and the shape of the exterior wall board 2 are not limited to those mentioned above. For example, a metal material, a wood material, a resin material, or the like may be selectable, as appropriate, for the material of the exterior wall board 2. In addition, as the shape of the exterior wall board 2, for example, a substantially rectangular vertically long plate material that has a quadrilateral shape may be selectable, as appropriate.

As illustrated in FIG. 1, a plurality of the exterior wall boards 2 are fastened, in a state of being adjacent to each other in the up-down direction and in the left-right direction, to the structure 8 with known fasteners, for example, fasteners 90, to cover an outer surface of the structure 8. As illustrated in FIG. 2, the exterior wall board 2 has a first face 2F and a second face 2B. The first face 2F is a face of the exterior wall board 2 facing the exterior side. The second face 2B is a face of the exterior wall board 2 facing the interior side.

In the present embodiment, the first face 2F is the wood cement board constituting the exterior wall board 2 and includes a coating layered thereon, the coating having a mirror-like glossy surface. In other words, the first face 2F has a smooth design surface 3. The design surface 3 has, for example, a length of about 3 m in the left-right direction and a length of about 0.5 m in the up-down direction; however, the size of the design surface 3 is not particularly limited.

A first design end portion 3D is a lower end portion of the design surface 3. A second design end portion 3U is an upper end portion of the design surface 3, the second design end portion 3U being opposite to the first design end portion 3D. The first design end portion 3D and the second design end portion 3U extend parallel to each other in the left-right direction.

A third design end portion 3R is a right end portion of the design surface 3, the third design end portion 3R being orthogonal to the first design end portion 3D. A fourth design end portion 3L is a left end portion of the design surface 3, the fourth design end portion 3L being orthogonal to the first design end portion 3D and being opposite to the third design end portion 3R. The third design end portion 3R and the fourth design end portion 3L extend parallel to each other in the up-down direction.

A first design surface 31 is a rectangular flat surface that is spaced inward from each of the first design end portion 3D, the second design end portion 3U, the third design end portion 3R, and the fourth design end portion 3L.

Second design surfaces 32D, 32U, 32R, and 32L are chamfered portions of end portions at the four sides of the design surface 3. The second design surfaces 32D, 32U, 32R, and 32L connect the design end portions at the four sides and the first design surface 31 to each other and incline at an angle of approximately 45 degrees with respect to the first design surface 31. The second design surfaces 32D, 32U, 32R, and 32L each have a width of, for example, about 2.0 to 3.0 mm; however, the width thereof is not particularly limited.

The exterior wall board 2 includes a first rear-surface-side joining portion 21 at an upper end portion thereof. The exterior wall board 2 includes a first front-surface-side joining portion 22 at a lower end portion thereof, that is, at a portion of the exterior wall board 2 opposite to the first rear-surface-side joining portion 21. The exterior wall board 2 includes a second rear-surface-side joining portion 23 at a right end portion thereof. The exterior wall board 2 includes a second front-surface-side joining portion 24 at a left end portion thereof, that is, at a portion of the exterior wall board 2 opposite to the second rear-surface-side joining portion 23. Each of the first rear-surface-side joining portion 21, the first front-surface-side joining portion 22, the second rear-surface-side joining portion 23, and the second front-surface-side joining portion 24 is also called a "shiplap portion (i.e. tongue portion)".

Note that, in FIG. 2 to FIG. 8, each of the second design surfaces 32D, 32U, 32R, and 32L, the first rear-surface-side joining portion 21, the first front-surface-side joining portion 22, the second rear-surface-side joining portion 23, and the second front-surface-side joining portion 24 is illustrated such that the size thereof is exaggerated with respect to the size of the exterior wall board 2.

As illustrated in FIG. 2, the first rear-surface-side joining portion 21 is recessed, in a step shape, from the first face 2F toward the second face 2B of the exterior wall board 2 and projects upward on the side of the second face 2B. The first rear-surface-side joining portion 21 extends in the left-right direction along the second design end portion 3U. The first rear-surface-side joining portion 21 has a surface 21F on the side of the first face 2F, the surface 21F vertically extending from the side of the second design end portion 3U and inclining toward the second face 2B. In other words, the sectional shape of the first rear-surface-side joining portion 21 is upwardly tapered.

A caulking 21S is disposed on the surface 21F of the first rear-surface-side joining portion 21. The caulking 21S is linearly disposed along the first rear-surface-side joining portion 21. Note that caulking is not essential and the caulking 21S of the present embodiment may be omitted. In FIG. 2 and the subsequent figures, the caulking 21S is not illustrated.

The first front-surface-side joining portion 22 is recessed, in a step shape, from the second face 2B toward the first face 2F of the exterior wall board 2 and projects downward on the side of the first face 2F. The first front-surface-side joining portion 22 extends in the left-right direction along the first design end portion 3D. The first front-surface-side joining portion 22 has a surface 22F on the side of the first face 2F, the surface 22F including a lower end portion of the first design surface 31 and the second design surface 32D. The first front-surface-side joining portion 22 has an upper end portion on the side of the second face 2B, the upper end portion being recessed to be upwardly tapered.

The second rear-surface-side joining portion 23 is recessed, in a step shape, from the first face 2F toward the second face 2B of the exterior wall board 2 and projects rightward on the side of the second face 2B. The second rear-surface-side joining portion 23 extends in the up-down direction along the third design end portion 3R.

A caulking 23S is disposed on a surface of the second rear-surface-side joining portion 23 on the side of the first face 2F. The caulking 23S is linearly disposed along the second rear-surface-side joining portion 23. Note that caulking is not essential and the caulking 23S of the present embodiment may be omitted. In FIG. 2 and the subsequent figures, the caulking 23S is not illustrated.

The second front-surface-side joining portion 24 is recessed, in a step shape, from the second face 2B toward the first face 2F of the exterior wall board 2 and projects leftward on the side of the first face 2F. The second front-surface-side joining portion 24 extends in the up-down direction along the fourth design end portion 3L.

Figure 6:
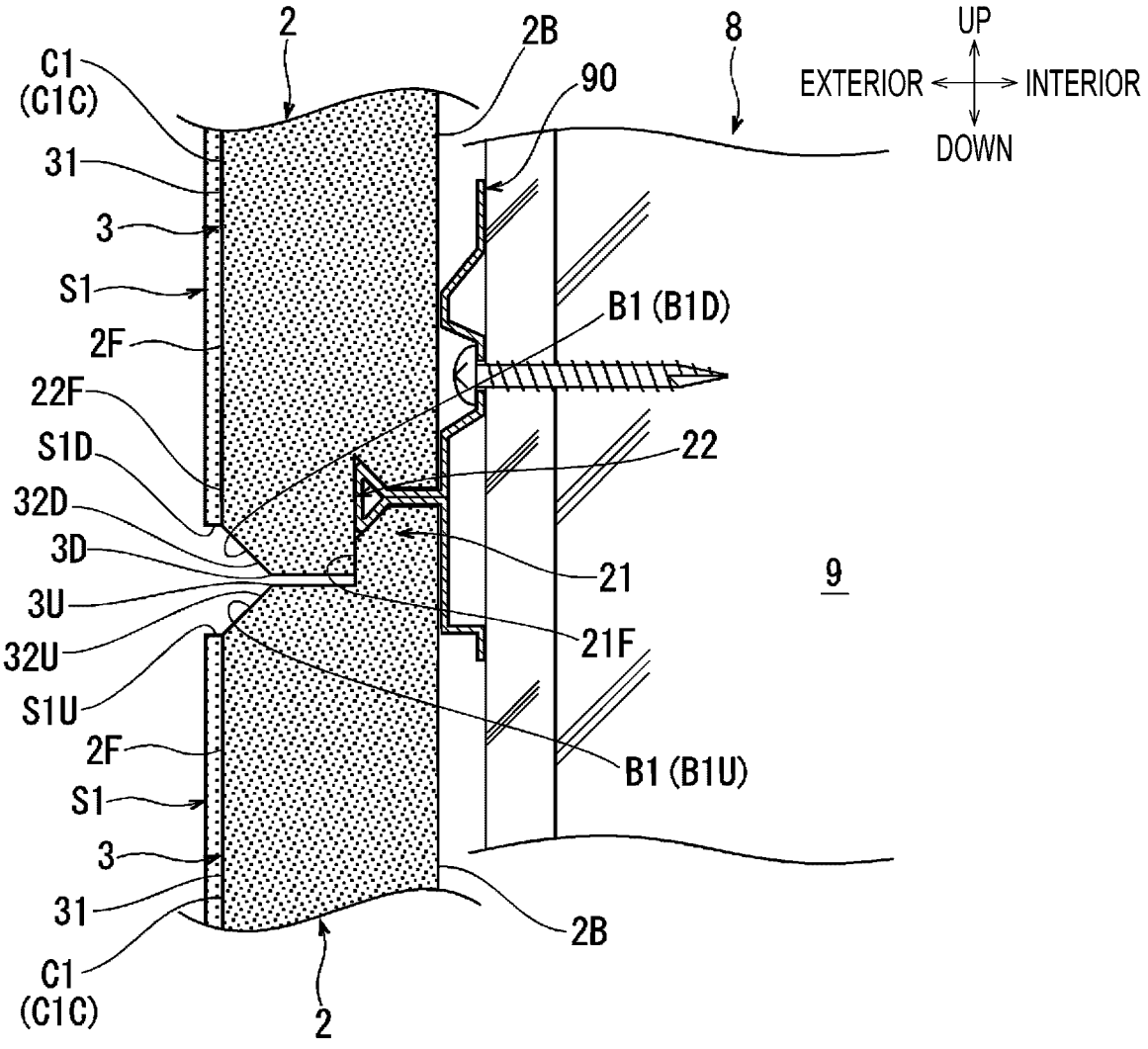
FIG. 6, which relates to the first embodiment, is a partial sectional view illustrating a state in construction.

As illustrated in FIG. 6, the first rear-surface-side joining portion 21 and the first front-surface-side joining portion 22 are joinable to each other as a result of a pair of the exterior wall boards 2 being vertically adjacent to each other. More specifically, as a result of the first rear-surface-side joining portion 21 of the exterior wall board 2 on the lower side and the first front-surface-side joining portion 22 of the exterior wall board 2 on the upper side overlapping each other in an interior-exterior direction, an up-down shiplap portion is formed between the exterior wall boards 2 adjacent to each other in the up-down direction.

The second rear-surface-side joining portion 23 and the second front-surface-side joining portion 24 are joinable to each other as a result of a pair of the exterior wall boards 2 being adjacent to each other in the left-right direction (not illustrated). More specifically, as a result of the second rear-surface-side joining portion 23 of the exterior wall board 2 on the left side and the second front-surface-side joining portion 24 of the exterior wall board 2 on the right side overlapping each other in the interior-exterior direction, a left-right shiplap portion is formed between the exterior wall boards 2 adjacent to each other in the left-right direction.

In other words, the exterior wall board 2, which includes the first rear-surface-side joining portion 21, the first front-surface-side joining portion 22, the second rear-surface-side joining portion 23, and the second front-surface-side joining portion 24, is a plate material that has a structure commonly known as a "four-side shiplap structure".

As the protective sheet S1, illustrated in FIG. 3 to FIG. 8, a known protective sheet that is affixed to a surface of an article in a peelable manner to suppress the surface of the article from being damaged during storage, transport, construction, and the like of the article is used. More specifically, the protective sheet S1 has a base layer, which is a sheet, and an adhesive layer layered on one surface of the base layer. Examples of the material of the base layer include polyethylene, polypropylene, polyolefin, polyvinyl chloride, non-woven fabric, paper, and the like. The adhesive layer has an adhesive force that is capable of reliably affixing the protective sheet S1 to the first face 2F of the exterior wall board 2 and that suppresses the adhesive layer from remaining on the first face 2F when the protective sheet S1 is peeled off from the first face 2F of the exterior wall board 2. Examples of the material of the adhesive layer include a synthetic rubber material, an acrylic material, and the like. Examples of the method of forming the adhesive layer include a method of applying an adhesive material on the base layer, which is a sheet, to form the adhesive layer, a method of extruding the base layer and an adhesive material together into a sheet shape to form the adhesive layer, and the like.

Affixing of the protective sheet S1 to the exterior wall board 2 will be described. First, the protective sheet S1 in a roll shape with the adhesive layer placed inside is disposed on the exterior wall board 2 having the first face 2F facing upward. Next, one end of the protective sheet S1 is disposed such that the adhesive layer comes into contact with the first face 2F of the exterior wall board 2, and the exterior wall board 2 or the protective sheet S1 is moved to affix the protective sheet S1 to the first face 2F of the exterior wall board 2. Next, the protective sheet S1 is cut to a predetermined length.

Figure 3:
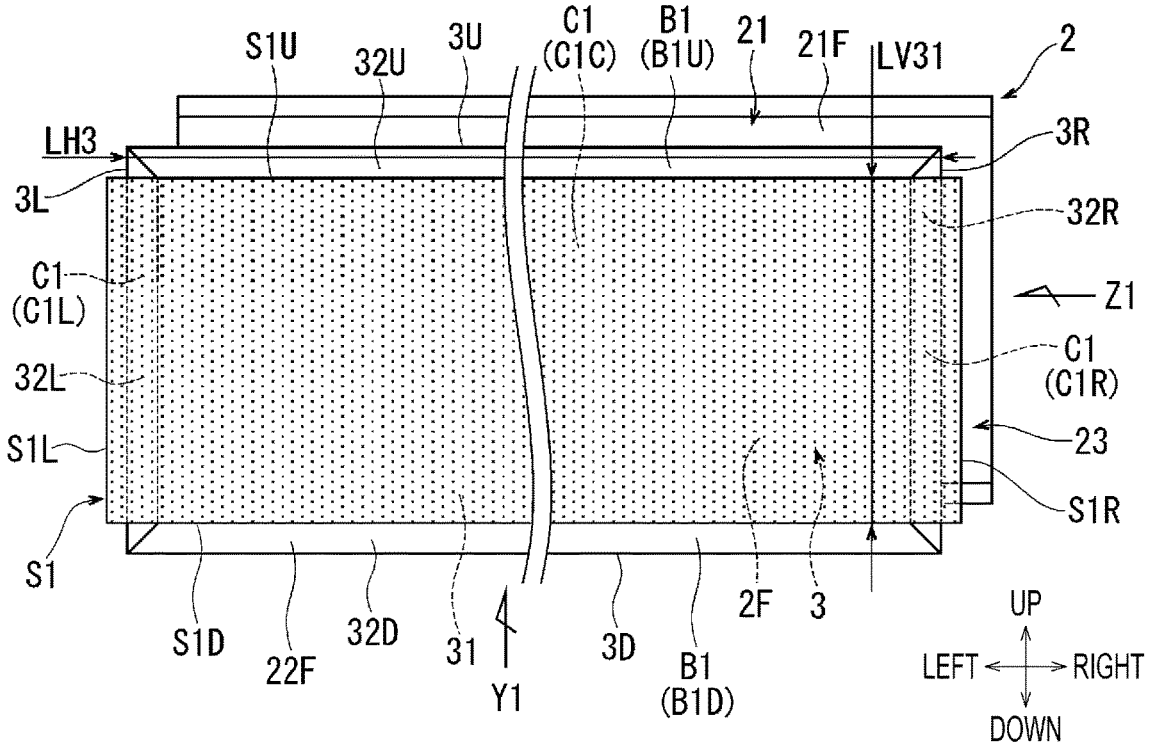
FIG. 3, which relates to the first embodiment, is a front view of the exterior wall board to which a protective sheet is affixed.
Figure 4:
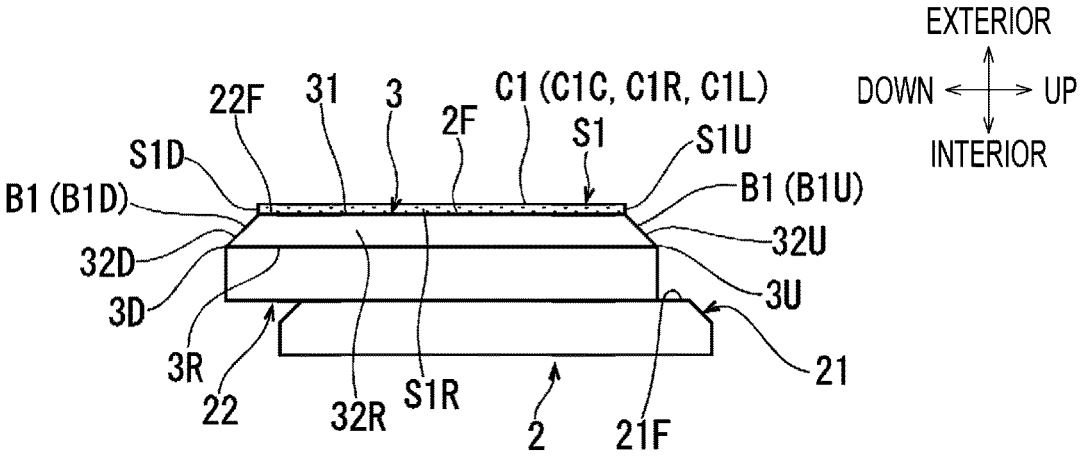
FIG. 4, which relates to the first embodiment, is a side view of FIG. 3 as viewed in arrow Z1 direction.
Figure 5:
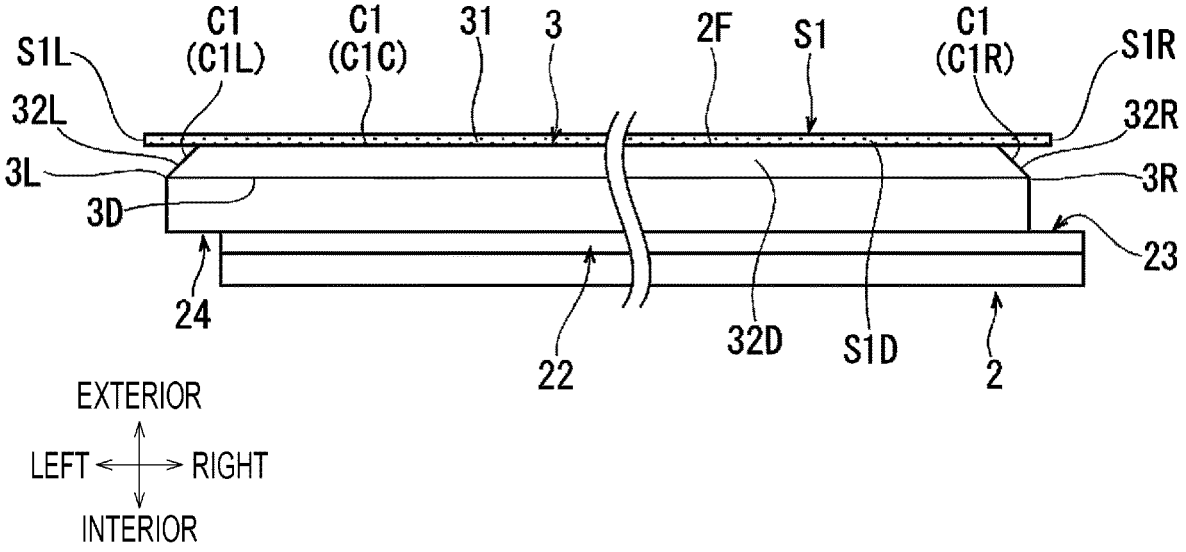
FIG. 5, which relates to the first embodiment, is a side view of FIG. 3 as viewed in arrow Y1 direction.

As illustrated in FIG. 3 to FIG. 5, the protective sheet S1 in a state of being affixed to the first face 2F of the exterior wall board 2 has a rectangular shape. The protective sheet S1 has sheet ends S1D, S1U, S1R, and S1L, which are end portions of the four sides.

The sheet end S1D is a lower end portion of the protective sheet S1. The sheet end S1U is an upper end portion of the protective sheet S1, the sheet end S1U being opposite to the sheet end S1D. The sheet end S1D and the sheet end S1U extend parallel to each other in the left-right direction.

The sheet end S1R is a right end portion of the protective sheet S1, the sheet end S1R being orthogonal to the sheet end S1D. The sheet end S1L is a left end portion of the protective sheet S1, the sheet end S1L being orthogonal to the sheet end S1D and being opposite to the sheet end S1R. The sheet end S1R and the sheet end S1L extend parallel to each other in the up-down direction.

The protective sheet S1 extends substantially parallel to the first design end portion 3D and the second design end portion 3U in the left-right direction and extends substantially parallel to the third design end portion 3R and the fourth design end portion 3L in the up-down direction to cover, in a contact state, the entire surface of the first design surface 31. As illustrated in FIG. 3 and FIG. 4, the length of the protective sheet S1 in the up-down direction is set to be equal to a length LV31 of the first design surface 31 in the up-down direction. Thus, the sheet end S1D of the protective sheet S1 does not protrude downward from the first design surface 31. In other words, the second design surface 32D is not covered with the protective sheet S1. In addition, the sheet end S1U of the protective sheet S1 does not protrude upward from the first design surface 31. In other words, the second design surface 32U and the surface 21F of the first rear-surface-side joining portion 21 on the side of the first face 2F are not covered with the protective sheet S1.

As illustrated in FIG. 3 and FIG. 5, the length of the protective sheet S1 in the left-right direction is set to be greater than a length LH3 of the design surface 3 in the left-right direction. Thus, the sheet end S1R of the protective sheet S1 is located on the right side of the third design end portion 3R, and the protective sheet S1 extends rightward, in a non-contact state of being not in contact with the second design surface 32R, from the first design surface 31. The sheet end S1L of the protective sheet S1 is located on the left side of the fourth design end portion 3L, and the protective sheet S1 extends leftward, in a non-contact state of being not in contact with the second design surface 32L, from the first design surface 31. The distance by which each of the sheet ends S1R and S1L of the protective sheet S1 protrudes rightward or leftward from the design surface 3 is, for example, about 5 mm but is not particularly limited.

In other words, the design surface 3 includes a covered regions C1 (C1C, C1R, and C1L) covered by the protective sheet S1 and thereby protected and an exposed region B1 (B1D and B1U) not covered by the protective sheet S1.

The covered region C1C is formed on the entire surface of the first design surface 31. The covered region C1R is formed on the second design surface 32R. The covered region C1L is formed on the second design surface 32L.

The exposed region BID is formed on the second design surface 32D and extends along the first design end portion 3D. The exposed region B1D is formed on the surface 22F of the first front-surface-side joining portion 22 on the side of the first face 2F. The exposed region B1U is formed on the second design surface 32U and extends along the second design end portion 3U.

A method of constructing the building material illustrated in FIG. 3 to FIG. 5 includes a first step and a second step. More specifically, as illustrated in FIG. 6, the exterior wall board 2 to which the protective sheet S1 is affixed is fastened to the structure 8 of a building in the first step during construction. During the step, the covered region C1 of the design surface 3 is protected by the protective sheet S1. Next, in the second step, after the first step, the protective sheet S1 is peeled off from the design surface 3. As a result, as illustrated in FIG. 1, the design surface 3 of the exterior wall board 2 exerts design characteristics.

Figure 7:
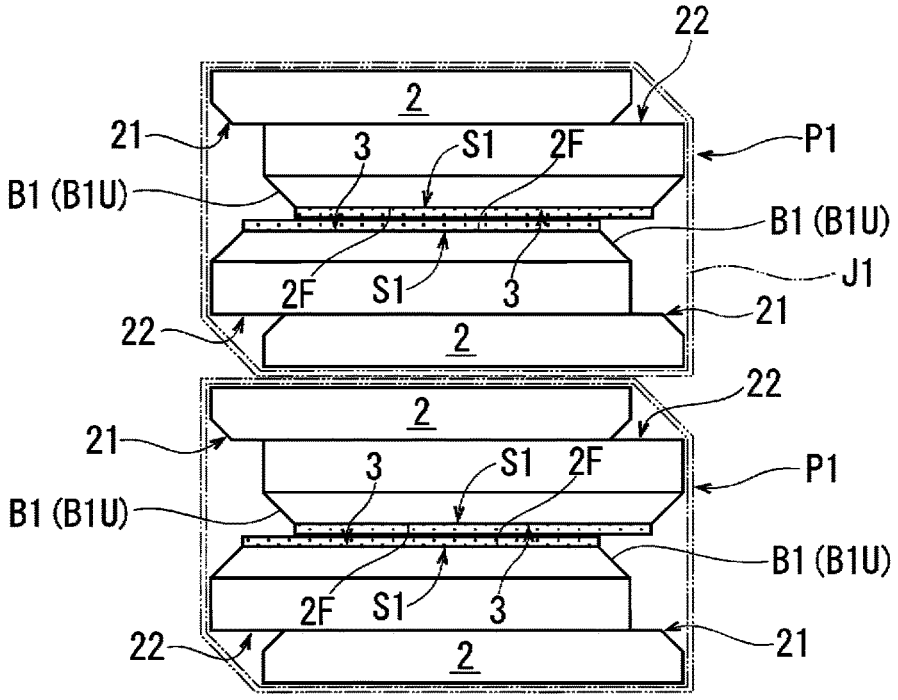
FIG. 7, which relates to the first embodiment, is a side view of a stacked body of building materials.
Figure 8:
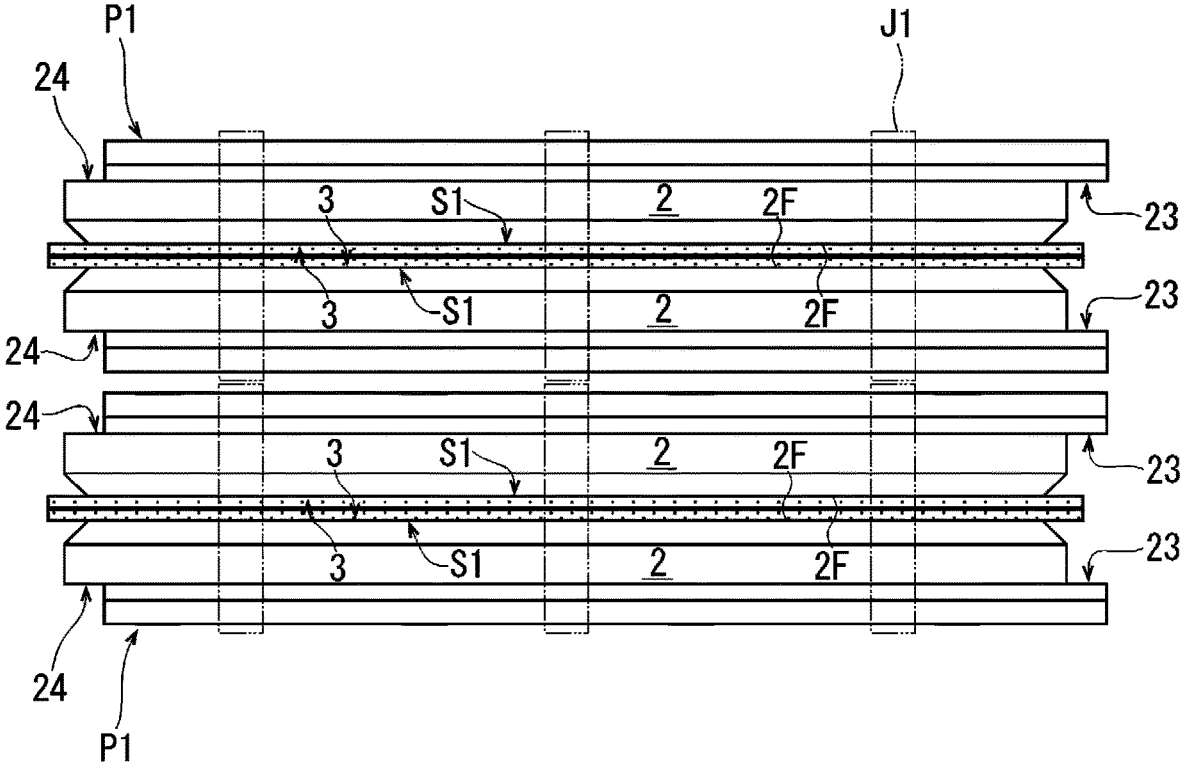
FIG. 8, which relates to the first embodiment, is another side view of the stacked body of building materials.

The building materials are stored and transported, as illustrated in FIG. 7 and FIG. 8, as a stacked body in which the exterior wall boards 2, to each of which the protective sheet S1 is affixed, are stacked on each other.

A pair of the building materials constituting the stacked body forms a set P1. More specifically, one of the building materials is rotated 180 degrees to cause the first face 2F to face downward and is disposed on the upper side, and the other building material having the first face 2F facing upward is disposed below and opposite the one of the building materials. As a result, as illustrated in FIG. 7 and FIG. 8, the pair of building materials constituting the set P1 are stacked on each other in a state in which respective first faces 2F are opposite each other.

A plurality of the sets P1 are stacked on each other in a state in which each of the sets P1 is bound with a binding material J1, and a stacked body of building materials is thereby completed. Note that a stacked body of building materials may be formed per set P1. In addition, the binding material J1 may bind a plurality of the sets P1 together.

As illustrated in FIG. 8, in the stacked body of building materials, the second rear-surface-side joining portion 23 of one of the building materials constituting the set P1 is located on a side identical to a side where the second rear-surface-side joining portion 23 of another of the building materials constituting the set P1 is located. The second front-surface-side joining portion 24 of one of the building materials constituting the set P1 is located on a side identical a side where the second front-surface-side joining portion 24 of the other of the building materials constituting the set P1 is located.

Meanwhile, as illustrated in FIG. 7, the first rear-surface-side joining portion 21 of one of the building materials constituting the set P1 is located on a side opposite to the side where the first rear-surface-side joining portion 21 of another of the building materials constituting the set P1 is located. The first front-surface-side joining portion 22 of one of the building materials constituting the set P1 is located on a side opposite to the side where the first front-surface-side joining portion 22 of the other of the building materials constituting the set P1 is located.

The exposed region B1U of one of the building materials constituting the set P1 is protected, in a non-contact state, by the protective sheet S1 covering the covered region C1 of another of the building materials constituting the set P1.

<Effects>

As illustrated in FIG. 3 to FIG. 5, in the building material and the building-material construction method according to the first embodiment, the covered region C1 of the design surface 3 formed within the first face 2F of the exterior wall board 2 is covered with the peelable protective sheet S1 and thereby protected. Thus, as illustrated in FIG. 6, the covered region C1 of the design surface 3 is suppressed from being damaged during the first step in the construction.

Meanwhile, as illustrated in FIG. 3 to FIG. 5, the exposed region B1D of the design surface 3 extends along the first design end portion 3D. The exposed region B1U of the design surface 3 extends along the second design end portion 3U. The exposed regions BID and B1U are not covered with the protective sheet S1. Thus, as illustrated in FIG. 6, the first design end portion 3D and the second design end portion 3U of each of the design surfaces 3 of the exterior wall boards 2 adjacent to each other in the up-down direction are exposed during the first step in construction. In other words, the sheet end S1D of the protective sheet S1 is spaced upward from the first design end portion 3D, and the sheet end S1U of the protective sheet S1 is spaced downward from the second design end portion 3U. It is thus possible to suppress the inconvenience of the sheet ends S1D and S1U of the protective sheet S1 being caught between the exterior wall boards 2 adjacent to each other in the vicinity of the first design end portion 3D and the second design end portion 3U.

Moreover, it is not necessary to perform operation while paying attention to prevent the sheet ends SiD and S1U of the protective sheet S1 from being caught between the exterior wall boards 2 adjacent to each other in the vicinity of the first design end portion 3D and the second design end portion 3U.

In addition, it is possible to eliminate the extra construction labor, for example, extracting a caught portion of the protective sheet S1 with attention to prevent breakage thereof.

Moreover, during the second step in construction, the sheet ends S1D and S1U of the exterior wall boards 2 adjacent to each other, each of the sheet ends S1D and S1U serving as a starting point for peeling off the protective sheet S1, are also spaced from each other in the vicinity of the first design end portion 3D and the second design end portion 3U, which enables easy peeling of the protective sheet S1.

Consequently, according to the building material and the building-material construction method of the first embodiment, it is possible to improve the construction properties while suppressing the design surface 3 from being damaged.

Moreover, according to the building material, as illustrated in FIG. 3 to FIG. 5, the second design surfaces 32D, 32U, 32R, and 32L are the chamfered portions of the end portions at the four sides of the design surface 3. Consequently, it is possible to suppress the design surface from being damaged, not only during construction, but also during storage and transport, as illustrated in FIG. 7 and FIG. 8. Due to the exposed regions B1D and B1U including the second design surfaces 32D and 32U, which are the chamfered portions, as illustrated in FIG. 6, the sheet ends S1D and S1U of the protective sheet S1 are further suppressed from being easily caught between the exterior wall boards 2 adjacent to each other in the up-down direction during the first step in construction. As a result, the building material is capable of further improving the construction properties.

In the building material, the protective sheet S1 covers, in the contact state, the entire surface of the first design surface 31, as illustrated in FIG. 3 and FIG. 5. Meanwhile, the protective sheet S1 extends rightward, in the non-contact state of being not in contact with the second design surface 32R, from the first design surface 31. The protective sheet S1 also extends leftward, in the non-contact state of being not in contact with the second design surface 32L, from the first design surface 31. In other words, the sheet ends S1R and S1L of the protective sheet S1 are spaced from the second design surfaces 32R and 32L. Thus, the building material enables the sheet ends S1R and S1L of the protective sheet S1 to be easily peeled off during the second step in construction.

As illustrated in FIG. 6, in the building material, the surface 21F of the first rear-surface-side joining portion 21 on the side of the first face 2F is joined, in a state of not being covered by the protective sheet S1, to the first front-surface-side joining portion 22 and concealed in construction. The first design end portion 3D extends on the side of the first front-surface-side joining portion 22 with respect to the first face 2F. The exposed region B1D formed on the surface 22F of the first front-surface-side joining portion 22 on the side of the first face 2F extends along the first design end portion 3D. Thus, the sheet ends S1D and S1U of the protective sheet S1 are further suppressed, during the first step in construction, from being easily caught at a joint portion between the first front-surface-side joining portion 22 and the first rear-surface-side joining portion 21 of the exterior wall boards 2 adjacent to each other in the up-down direction. As a result, the building material is capable of further improving the construction properties.

Moreover, in the stacked body of building materials according to the first embodiment, as illustrated in FIG. 7, the exposed region B1U of one of the building materials constituting the set P1 is protected, in a non-contact state, by the protective sheet S1 covering the covered region C1 of another of the building materials constituting the set P1. Consequently, even when, for example, the exposed region B1U of one of the building materials nearly comes into contact with the design surface 3 of the other of the building materials as a result of the other of the building materials inclining with respect to the one of the building materials during packing or unpacking, the stacked body of building materials is capable of suppressing the exposed region B1U from being damaged, by using the protective sheet S1 of the other of the building materials.

Second Embodiment

Figure 9:
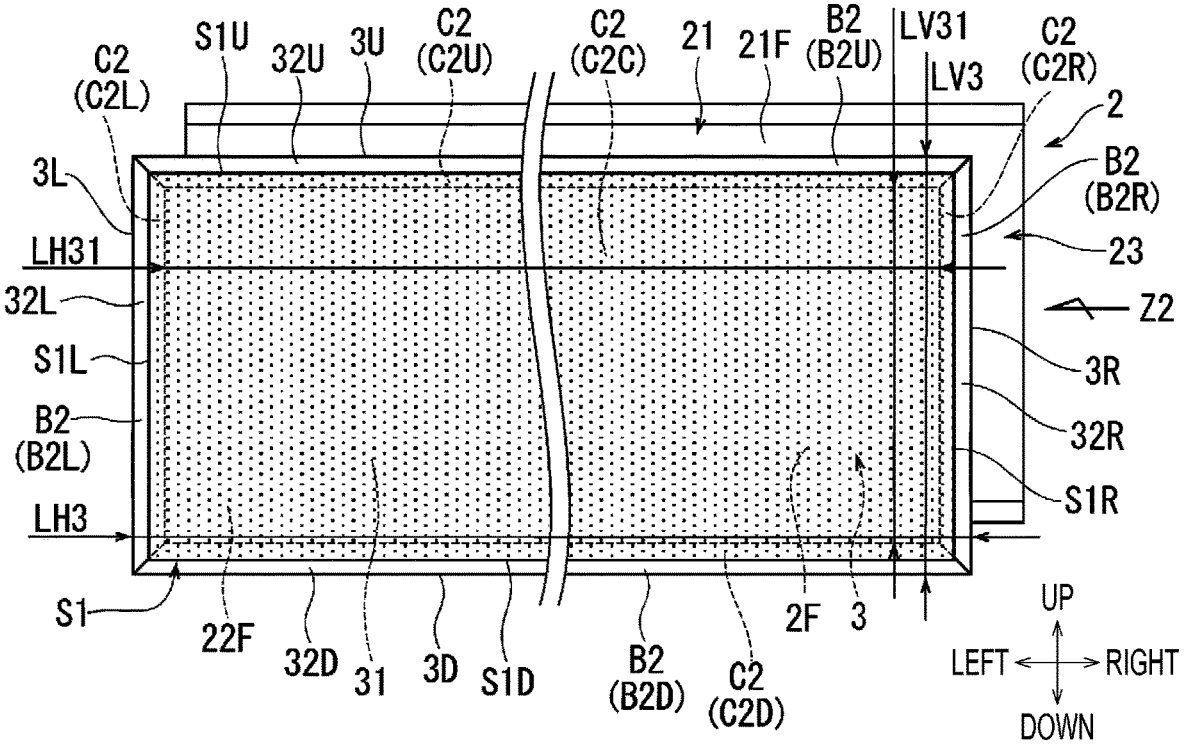
FIG. 9, which relates to a second embodiment, is a front view of the exterior wall board to which the protective sheet is affixed.
Figure 10:
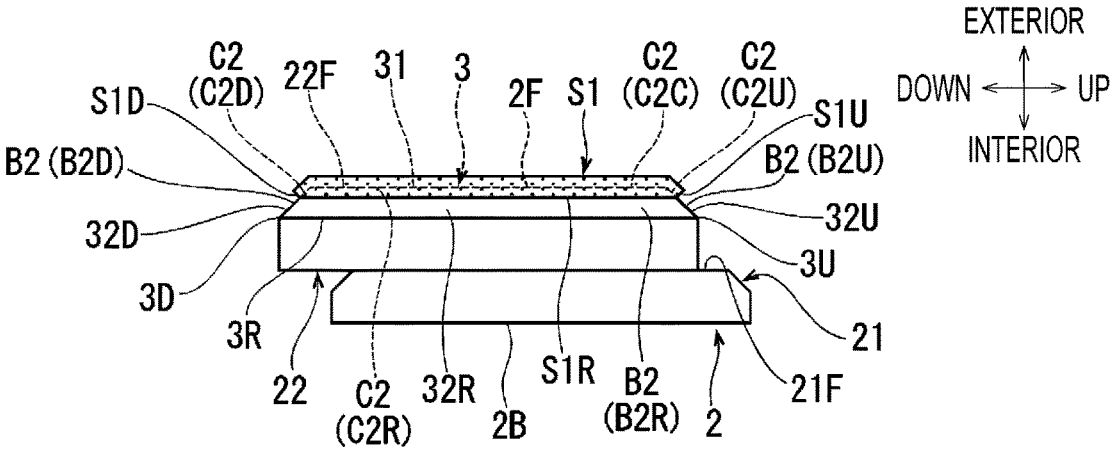
FIG. 10, which relates to the second embodiment, is a side view of FIG. 9 as viewed in arrow Z2 direction.

In the building material, the stacked body of building materials, and the building-material construction method according to a second embodiment, the covered region C1 (C1C C1R, and C1L) and the exposed region B1 (B1D and B1U) of the design surface 3 according to the building material of the first embodiment have been changed, and, as illustrated in FIG. 9 and FIG. 10, the design surface 3 includes a covered region C2 (C2C, C2D, C2U, C2R, and C2L) and an exposed region B2 (B2D, B2U, B2R, and B2L). The other elements of the second embodiment are identical to those of the first embodiment. Thus, the elements identical to those of the first embodiment are given identical reference signs, and description thereof is omitted or simplified.

The length of the protective sheet S1 in the up-down direction is set to be greater than the length LV31 of the first design surface 31 in the up-down direction and to be smaller than a length LV3 of the design surface 3 in the up-down direction. In addition, the length of the protective sheet S1 in the left-right direction is set to be greater than a length LH31 of the first design surface 31 in the left-right direction and to be smaller than the length LH3 of the design surface 3 in the left-right direction. Thus, the sheet end S1D of the protective sheet S1 protrudes downward from the first design surface 31 while being located above the first design end portion 3D. The sheet end S1U of the protective sheet S1 protrudes upward from the first design surface 31 while being located below the second design end portion 3U. The sheet end S1R of the protective sheet S1 protrudes rightward from the first design surface 31 while being located on the left side of the third design end portion 3R. The sheet end S1L of the protective sheet S1 protrudes leftward from the first design surface 31 while being located on the right side of the fourth design end portion 3L.

The protective sheet S1 covers, in a contact state, the entire surface of the first design surface 31. In addition, the protective sheet S1 curves at ridges between the first design surface 31 and the second design surfaces 32D, 32U, 32R, and 32L and extends from the first design surface 31 to cover, in a contact state, a portion of each of the second design surfaces 32D, 32U, 32R, and 32L.

The covered region C2C is formed on the entire surface of the first design surface 31. The covered region C2D is formed to extend from the lower end portion of the first design surface 31 to an intermediate portion of the second design surface 32D. The covered region C2U is formed to extend from an upper end portion of the first design surface 31 to an intermediate portion of the second design surface 32U. The covered region C2R is formed to extend from a right end portion of the first design surface 31 to an intermediate portion of the second design surface 32R. The covered region C2L is formed to extend from a left end portion of the first design surface 31 to an intermediate portion of the second design surface 32L.

The exposed region B2D is formed on a portion of the second design surface 32D, the portion excluding the covered region C2D. The exposed region B2D extends along the first design end portion 3D. The exposed region B2D is formed on the surface 22F of the first front-surface-side joining portion 22 on the side of the first face 2F.

The exposed region B2U is formed on a portion of the second design surface 32U, the portion excluding the covered region C2U. The exposed region B2U extends along the second design end portion 3U.

The exposed region B2R is formed on a portion of the second design surface 32R, the portion excluding the covered region C2R. The exposed region B2R extends along the third design end portion 3R.

The exposed region B2L is formed on a portion of the second design surface 32L, the portion excluding the covered region C2L. The exposed region B2L extends along the fourth design end portion 3L.

In other words, the exposed regions B2D, B2U, B2R, and B2L extend along a corresponding one of the end portions at the four sides of the design surface 3.

According to the building material of to the second embodiment, the exterior wall board 2 to which the protective sheet S1 is affixed is fastened to the structure 8 of a building in the first step in construction. During the step, the covered region C2 of the design surface 3 is protected by the protective sheet S1. After the first step, the protective sheet S1 is peeled off from the design surface 3 in the second step.

The building material is stored and transported as a stacked body. The stacked body has been changed from the stacked body illustrated in FIG. 7 and FIG. 8 in terms of only the design surface 3 including the covered region C2 and the exposed region B2.

The exposed region B2U of one of the building materials constituting the set P1 is protected, in a non-contact state, by the protective sheet S1 covering the covered region C2 of another of the building materials constituting the set P1 (not illustrated).

<Effects>

In the building material and the building-material construction method according to the second embodiment, as illustrated in FIG. 9 and FIG. 10, the covered region C2 of the design surface 3 formed within the first face 2F of the exterior wall board 2 is covered with the peelable protective sheet S1 and thereby protected. Thus, during the first step in construction, the covered region C2 of the design surface 3 is suppressed from being damaged.

Meanwhile, the first design end portion 3D and the second design end portion 3U of the design surface 3 of the exterior wall boards 2 adjacent to each other in the up-down direction are exposed during the first step in construction. In other words, the sheet end S1D of the protective sheet S1 is spaced upward from the first design end portion 3D, and the sheet end S1U of the protective sheet S1 is spaced downward from the second design end portion 3U. It is thus possible to suppress the inconvenience of the sheet ends S1D and S1U of the protective sheet S1 being caught between the exterior wall boards 2 adjacent to each other in the vicinity of the first design end portion 3D and the second design end portion 3U.

In addition, the third design end portion 3R and the fourth design end portion 3L of the design surface 3 of the exterior wall boards 2 adjacent to each other in the left-right direction are exposed. In other words, the sheet end S1R of the protective sheet S1 is spaced leftward from the third design end portion 3R, and the sheet end S1L of the protective sheet S1 is spaced rightward from the fourth design end portion 3L. It is thus possible to suppress the inconvenience of the sheet ends S1R and S1L of the protective sheet S1 being caught between the exterior wall boards 2 adjacent to each other in the vicinity of the third design end portion 3R and the fourth design end portion 3L. Consequently, it is not necessary to perform operation while paying attention to prevent the sheet ends S1D, S1U, S1R, and S1L of the protective sheet S1 from being caught between the exterior wall boards 2 adjacent to each other in the vicinity of the first design end portion 3D, the second design end portion 3U, the third design end portion 3R, and the fourth design end portion 3L.

In addition, it is possible to eliminate the extra construction labor, for example, extracting a caught portion of the protective sheet S1 with attention to prevent breakage thereof.

Moreover, during the second step in construction, the sheet ends S1D, S1U, S1R, and S1L of the exterior wall boards 2 adjacent to each other, each of the sheet ends S1D, S1U, S1R, and S1L serving as a starting point for peeling off the protective sheet S1, are also spaced from each other in the vicinity of the first design end portion 3D, the second design end portion 3U, the third design end portion 3R, and the fourth design end portion 3L, which enables easy peeling of the protective sheet S1.

Consequently, the building material and the building-material construction method according to the second embodiment are also capable of improving the construction properties while suppressing the design surface 3 from being damaged.

Due to the second design surfaces 32D, 32U, 32R, and 32L inclining in the building material, the sheet ends S1D, S1U, S1R, and S1L of the protective sheet S1 covering the covered region C2, which is formed to extend from the first design surface 31 to the intermediate portions of each of the second design surfaces 32D, 32U, 32R, and 32L, are easily peeled off in the second step in construction. As a result, the building material is capable of further improving the construction properties.

Moreover, in the stacked body of building materials according to the second embodiment, the exposed region B2U of one of the building materials constituting the set P1 is protected, in the non-contact state, by the protective sheet S1 covering the covered region C2 of another of the building materials constituting the set P1. Consequently, even when, for example, the second design surface 32U of one of the building materials nearly comes into contact with the first design surface 31 of the other of the building materials as a result of the other of the building materials inclining with respect to the one of the building materials during packing or unpacking, the stacked body of building materials is capable of suppressing the second design surface 32U from being damaged, by using the protective sheet S1 of the other of the building materials.

Third Embodiment

Figure 11:
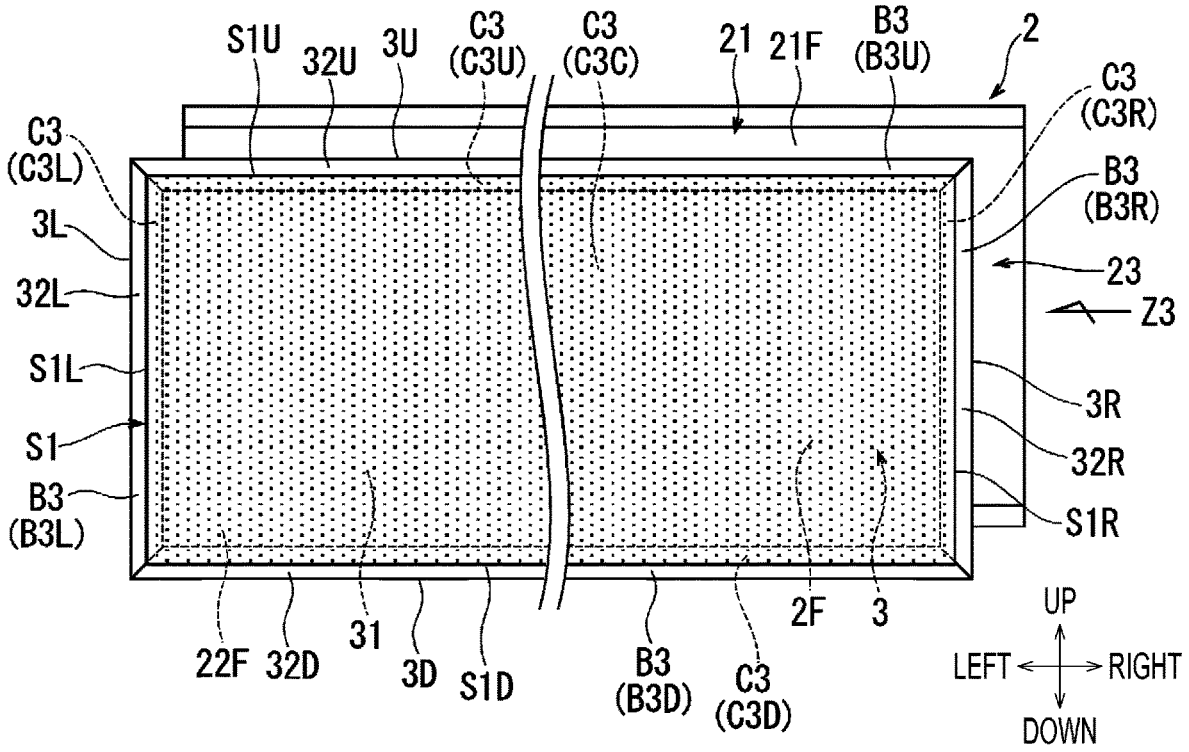
FIG. 11, which relates to a third embodiment, is a front view of the exterior wall board to which the protective sheet is affixed.
Figure 12:
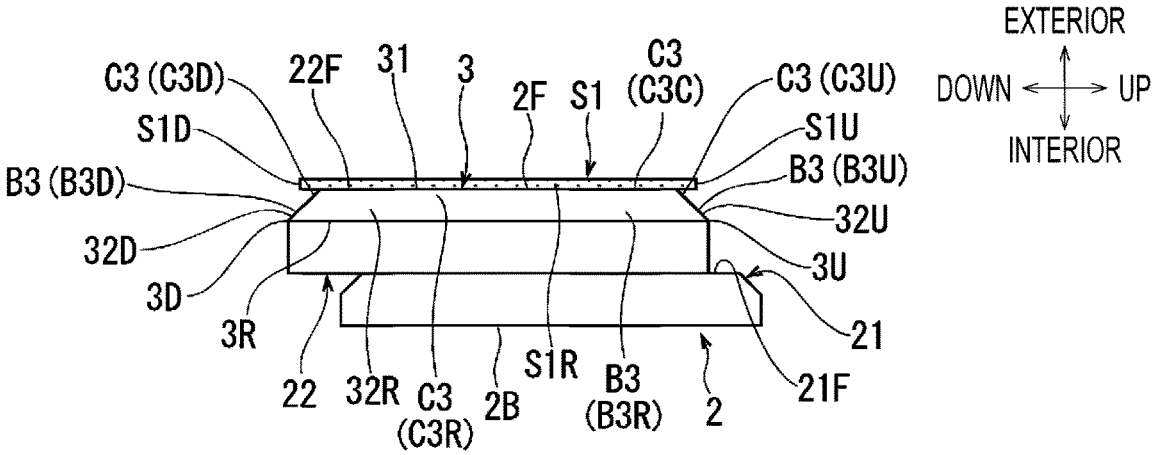
FIG. 12, which relates to the third embodiment, is a side view of FIG. 11 as viewed in arrow Z3 direction.

The building material, the stacked body of building materials, and the building-material construction method according to a third embodiment differs from those of the second embodiment in terms of the protective sheet S1 having been changed to extend outward, without curving at the ridges between the first design surface 31 and the second design surfaces 32D, 32U, 32R, and 32L, in a non-contact state of being not in contact with the second design surfaces 32D, 32U, 32R, and 32L, as illustrated in FIG. 11 and FIG. 12.

A covered region C3D has been changed to be covered, in a non-contact state, by the protective sheet S1 in an area from the lower end portion of the first design surface 31 to an intermediate portion of the second design surface 32D. A covered region C3U has been changed to be covered, in a non-contact state, by the protective sheet S1 in an area from the upper end portion of the first design surface 31 to an intermediate portion of the second design surface 32U. A covered region C3R has been changed to be covered, in a non-contact state, by the protective sheet S1 in an area from the right end portion of the first design surface 31 to an intermediate portion of the second design surface 32R. A covered region C3L has been changed to be covered, in a non-contact state, by the protective sheet S1 in an area from the left end portion of the first design surface 31 to an intermediate portion of the second design surface 32L.

The other elements of the third embodiment are identical to those of the second embodiment. For example, exposed regions B3D, B3U, B3R, and B3L are formed on a portion of a corresponding one of the second design surfaces 32D, 32U, 32R, and 32L, the portion excluding the covered regions C3D, C3U, C3R, and C3L, respectively. Thus, the elements identical to those of the first embodiment or the second embodiment are given identical reference signs, and description thereof is omitted or simplified.

According to the building material of the third embodiment, the exterior wall board 2 to which the protective sheet S1 is affixed is fastened to the structure 8 of a building in the first step in construction. During the step, a covered region C3 of the design surface 3 is protected by the protective sheet S1. After the first step, the protective sheet S1 is peeled off from the design surface 3 in the second step.

The building material is stored and transported as a stacked body. The stacked body has been changed from the stacked body of the second embodiment in terms of only the covered regions C3D, C3U, C3R, and C3L being covered, in a non-contact state, by the protective sheet S1.

The building material, the stacked body of building materials, and the building-material construction method according to the third embodiment having such a configuration are also capable of improving the construction properties while suppressing the design surface 3 from being damaged, similarly to the building material, the stacked body of building materials, and the building-material construction method of the first embodiment or the second embodiment.

In the building material, the sheet end S1D of the protective sheet S1 floats from the second design surface 32D on the upper side of the first design end portion 3D. The sheet end S1U of the protective sheet S1 floats from the second design surface 32U on the lower side of the second design end portion 3U. The sheet end S1R of the protective sheet S1 floats from the second design surface 32R on the left side of the third design end portion 3R. The sheet end S1L of the protective sheet S1 floats from the second design surface 32L on the right side of the fourth design end portion 3L. Thus, the sheet ends S1D, S1U, S1R, and S1L of the protective sheet S1 are easily peeled off in the second step in construction.

Moreover, in the building material, the sheet end S1D of the protective sheet S1 does not extend downward from the first design end portion 3D. The sheet end S1U of the protective sheet S1 does not extend upward from the second design end portion 3U. The sheet end S1R of the protective sheet S1 does not extend rightward from the third design end portion 3R. The sheet end Sit of the protective sheet S1 does not extend leftward from the fourth design end portion 3L. Thus, during the first step in construction, the sheet ends S1D, S1U, S1R, and S1L of the protective sheet S1 are suppressed from being easily caught between the exterior wall boards 2 adjacent to each other. As a result, the building material is capable of further improving the construction properties.

Fourth Embodiment

Figure 13:
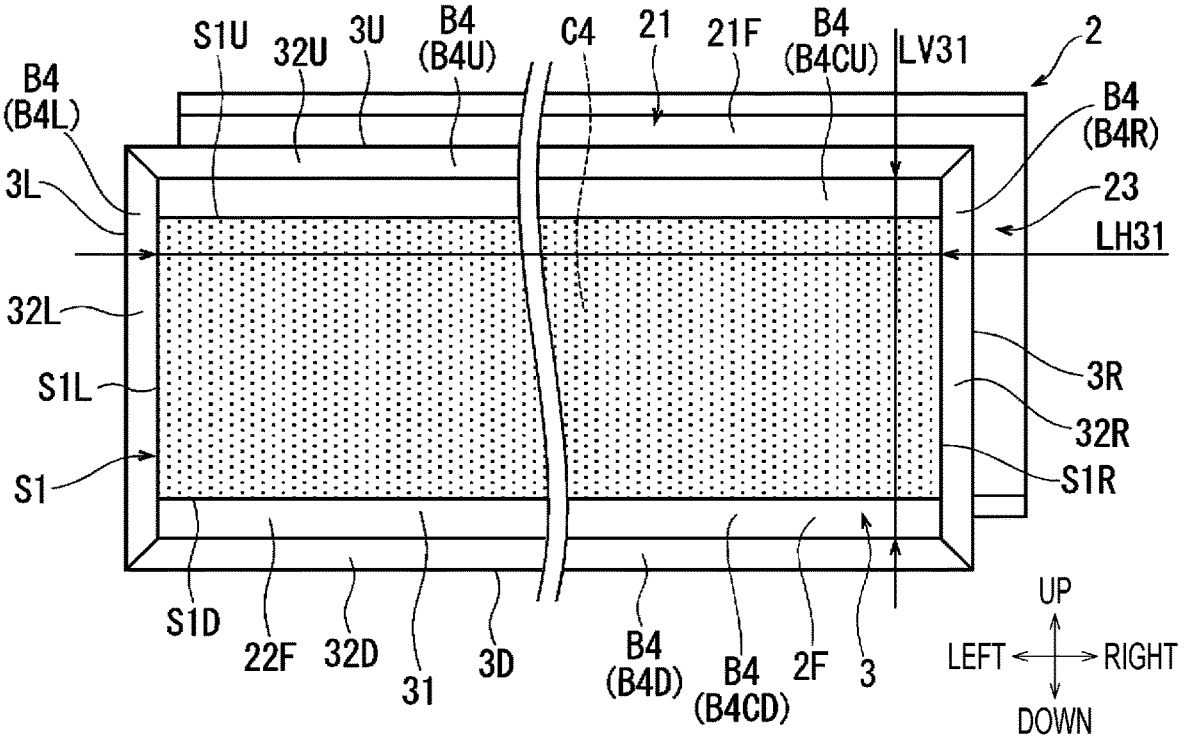
FIG. 13, which relates to a fourth embodiment, is a front view of the exterior wall board to which the protective sheet is affixed.
Figure 14:
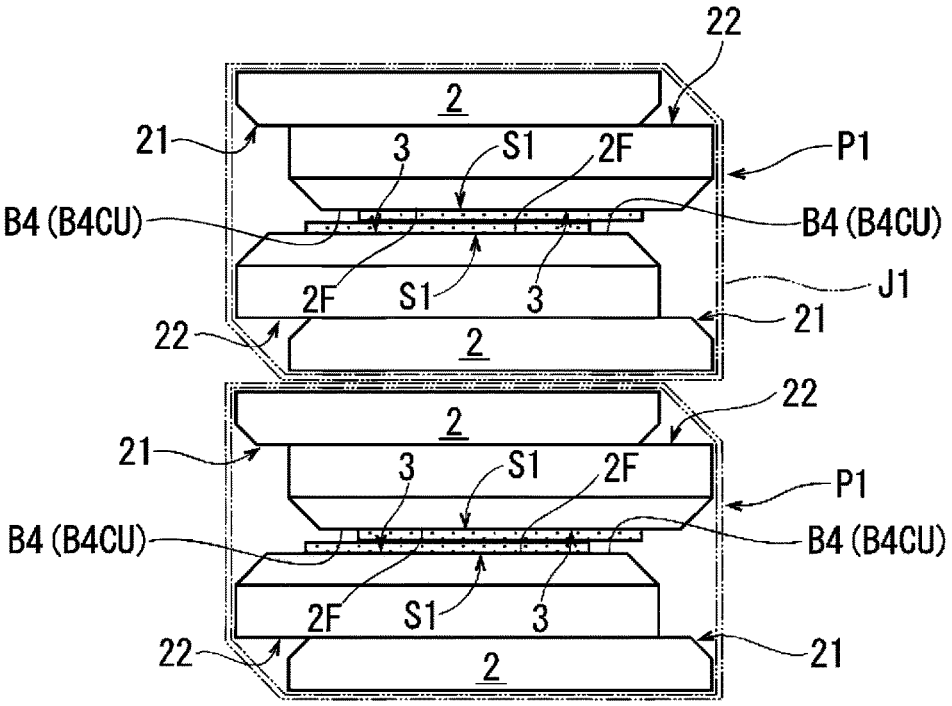
FIG. 14, which relates to the fourth embodiment, is a side view of the stacked body of building materials as viewed in the same direction as that in FIG. 7.

In the building material, the stacked body of building materials, and the building-material construction method according to a fourth embodiment, the covered region C1 (C1C, C1R, and C1L) and the exposed region B1 (B1D and B1U) of the design surface 3 according to the building material of the first embodiment have been changed, and, as illustrated in FIG. 13 and FIG. 14, the design surface 3 includes a covered region C4 and an exposed region B4 (B4CD, B4CU, B4D, B4U, B4R, and B4L). The other elements of the fourth embodiment are identical to those of the first embodiment. Thus, the elements identical to those of the first embodiment are given identical reference signs, and description thereof is omitted or simplified.

As illustrated in FIG. 13, the length of the protective sheet S1 in the up-down direction is set to be smaller than the length LV31 of the first design surface 31 in the up-down direction. The sheet ends S1D and S1U of the protective sheet S1 are spaced inward from the upper and lower ends of the first design surface 31, respectively. The distance by which the sheet ends S1D and S1U of the protective sheet S1 are respectively spaced inward from the upper and lower ends of the first design surface 31 is, for example, about 2.5 mm but not particularly limited.

The length of the protective sheet S1 in the left-right direction is set to be equal to the length LH31 of the first design surface 31 in the left-right direction. Thus, the sheet end S1R of the protective sheet S1 does not protrude rightward from the first design surface 31. In other words, the second design surface 32R is not covered with the protective sheet S1. In addition, the sheet end S1L of the protective sheet S1 does not protrude leftward from the first design surface 31. In other words, the second design surface 32L is not covered with the protective sheet S1.

The covered region C4 is formed on a portion of the first design surface 31, the portion being surrounded by the sheet ends S1D, S1U, S1R, and S1L.

The exposed regions B4CD and B4CU are each formed on a portion of the first design surface 31, the portion excluding the covered region C4. The exposed region B4CD extends along the first design end portion 3D. The exposed region B4CD is formed on the surface 22F of the first front-surface-side joining portion 22 on the side of the first face 2F. The exposed region B4CU extends along the second design end portion 3U.

The exposed region B4D is formed on the second design surface 32D and extends along the first design end portion 3D. The exposed region B4U is formed on the second design surface 32U and extends along the second design end portion 3U. The exposed region B4R is formed on the second design surface 32R and extends along the third design end portion 3R. The exposed region B4L is formed on the second design surface 32L and extends along the fourth design end portion 3L.

In other words, the exposed regions B4CD, B4CU, B4D, B4U, B4R, and B4L extend along a corresponding one of the end portions at the four sides of the design surface 3.

According to the building material of the fourth embodiment, the exterior wall board 2 to which the protective sheet S1 is affixed is fastened to the structure 8 of a building in the first step in construction (not illustrated). During the step, the covered region C4 of the design surface 3 is protected by the protective sheet S1. After the first step, the protective sheet S1 is peeled off from the design surface 3 in the second step.

The building material is stored and transported as the stacked body illustrated in FIG. 14. The stacked body has been changed from the stacked body of the first embodiment in terms of only the design surface 3 including the covered region C4 and the exposed region B4.

As illustrated in FIG. 14, the exposed region B4CU of one of the building materials constituting the set P1 is protected by the protective sheet S1 covering the covered region C4 of another of the building materials constituting the set P1. More specifically, the exposed region B4CU and the protective sheet S1 of the other of the building materials are opposite each other with a small gap therebetween, the gap being formed by the thickness of the protective sheet S1 of the one of the building materials. Consequently, even when, for example, the exposed region B4CU of one of the building materials nearly comes into contact with the design surface 3 of the other of the building materials during packing, storage, transport, unpacking, or the like, the exposed region B4CU is protected by the protective sheet S1 of the other of the building materials.

The building material, the stacked body of building materials, and the building-material construction method according to the fourth embodiment having such a configuration are also capable of improving the construction properties while suppressing the design surface 3 from being damaged, similarly to the building material, the stacked body of building materials, and the building-material construction method of the first to third embodiments.

Fifth Embodiment

Figure 15:
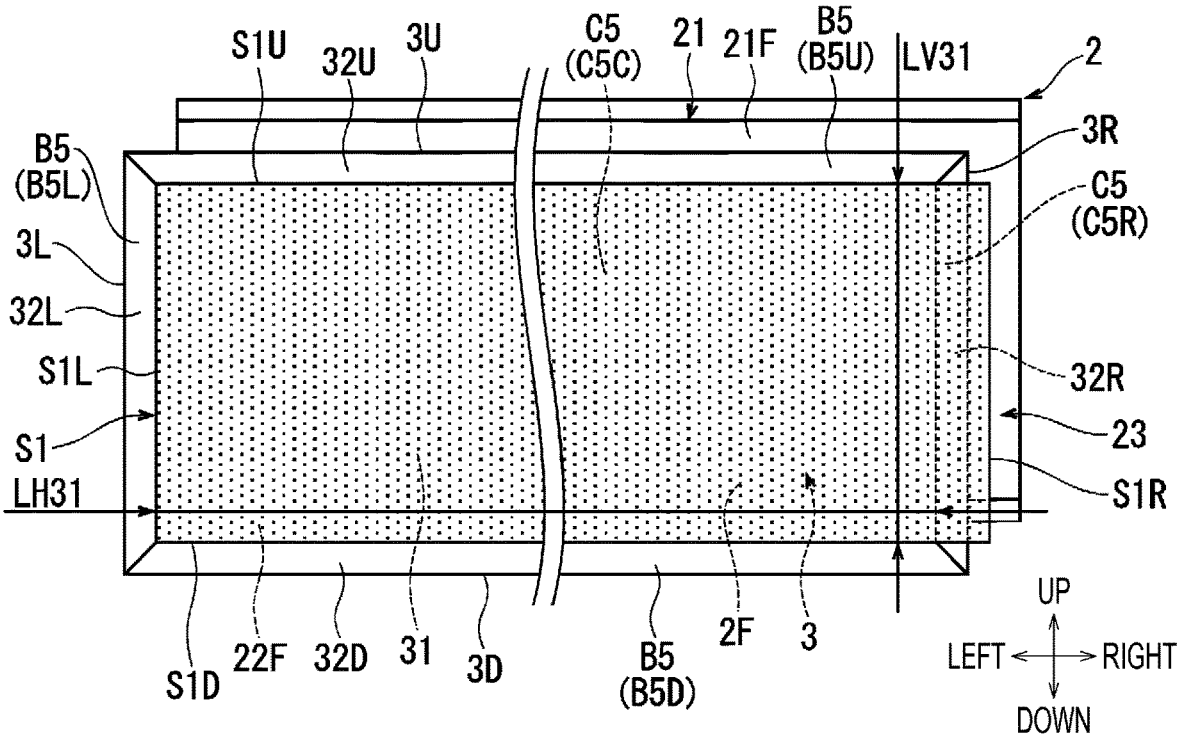
FIG. 15, which relates to a fifth embodiment, is a front view of the exterior wall board to which the protective sheet is affixed.

In the building material, the stacked body of building materials, and the building-material construction method according to a fifth embodiment, the covered region C1 (C1C, C1R, and C1L) and the exposed region B1 (B1D and B1U) of the design surface 3 according to the building material of the first embodiment have been changed, and, as illustrated in FIG. 15, the design surface 3 includes a covered region C5 (C5C and C5R) and an exposed region B5 (B5D, B5U, and B5L). The other elements of the fifth embodiment are identical to those of the first embodiment. Thus, the elements identical to those of the first embodiment are given identical reference signs, and description thereof is omitted or simplified.

The length of the protective sheet S1 in the up-down direction is set to be equal to the length LV31 of the first design surface 31 in the up-down direction. Thus, the sheet end S1D of the protective sheet S1 does not protrude downward from the first design surface 31. In other words, the second design surface 32D is not covered with the protective sheet S1. In addition, the sheet end S1U of the protective sheet S1 does not protrude upward from the first design surface 31. In other words, the second design surface 32U is not covered with the protective sheet S1.

The length of the protective sheet S1 in the left-right direction is set to be greater than the length LH31 of the first design surface 31 in the left-right direction. The sheet end S1L of the protective sheet S1 is disposed to be aligned with the left end portion of the first design surface 31 and does not protrude leftward from the first design surface 31. In other words, the second design surface 32L is not covered with the protective sheet S1. The sheet end S1R of the protective sheet S1 is located on the right side of the third design end portion 3R and floats from the second design surface 32R. In other words, the protective sheet S1 extends rightward, in a non-contact state of being not in contact with the second design surface 32R, from the first design surface 31. The distance by which the sheet end S1R of the protective sheet S1 protrudes rightward from the design surface 3 is, for example, about 5 mm but not particularly limited.

The covered region C5C is formed on the entire surface of the first design surface 31. The covered region C5R is formed on the second design surface 32R.

The exposed region B5D is formed on the second design surface 32D. The exposed region B5D extend along the first design end portion 3D. The exposed region B5D is formed on the surface 22F of the first front-surface-side joining portion 22 on the side of the first face 2F. The exposed region B5U is formed on the second design surface 32U. The exposed region B5U extends along the second design end portion 3U. The exposed region B5L is formed on the second design surface 32L. The exposed region B5L extends along the fourth design end portion 3L.

According to the building material of the fifth embodiment, the exterior wall board 2 to which the protective sheet S1 is affixed is fastened to the structure 8 of a building in the first step in construction (not illustrated). During the step, the covered regions C5C and C5R of the design surface 3 are protected by the protective sheet S1. After the first step, the protective sheet S1 is peeled off from the design surface 3 in the second step.

The building material is stored and transported as a stacked body (not illustrated). The stacked body has been changed from the stacked body of the first embodiment in terms of only the design surface 3 including the covered region C5 and the exposed region B5.

The exposed region B5U of one of the building materials constituting the set P1 is protected, in a non-contact state, by the protective sheet S1 covering the covered region C5 of another of the building materials constituting the set P1. Consequently, even when, for example, the exposed region B5U of one of the building materials nearly comes into contact with the design surface 3 of the other of the building materials as a result of the other of the building materials inclining with respect to the one of the building materials during packing or unpacking, the exposed region B5U is protected by the protective sheet S1 of the other of the building materials.

The building material, the stacked body of building materials, and the building-material construction method according to the fifth embodiment having such a configuration are also capable of improving the construction properties while suppressing the design surface 3 from being damaged, similarly to the building material, the stacked body of building materials, and the building-material construction method of the first to fourth embodiments.

Sixth Embodiment

Figure 16:
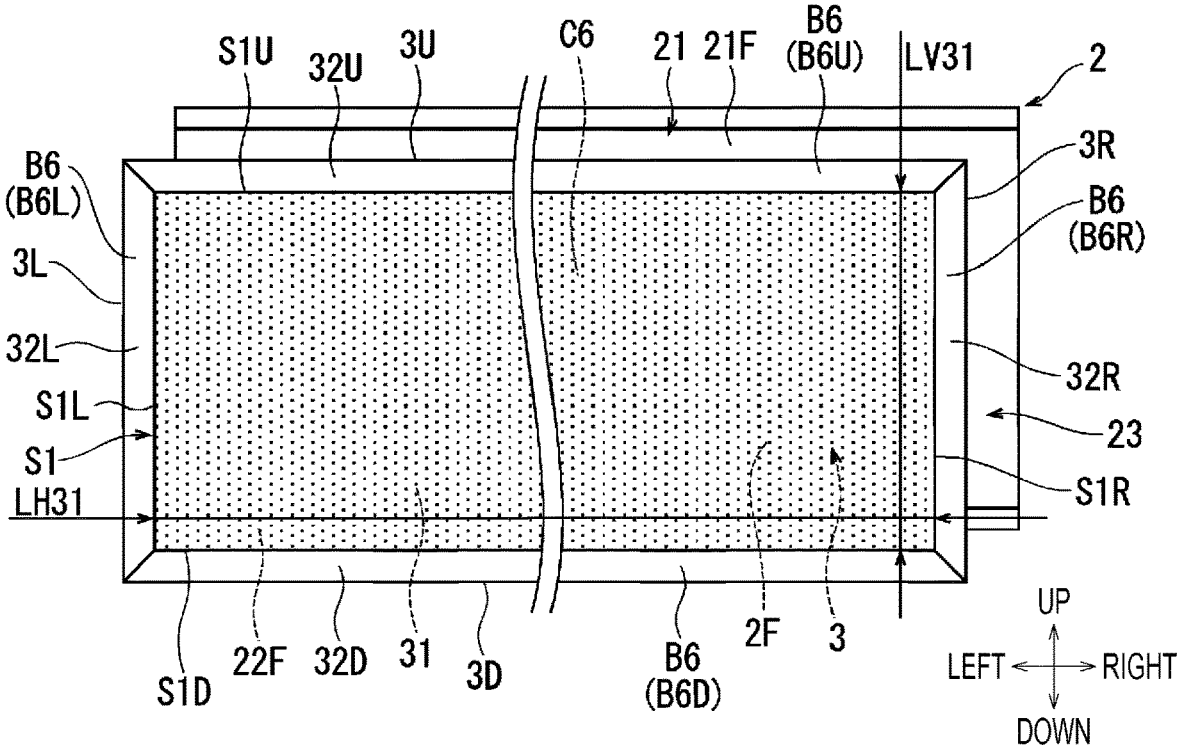
FIG. 16, which relates to a sixth embodiment, is a front view of the exterior wall board to which the protective sheet is affixed.

In the building material, the stacked body of building materials, and the building-material construction method according to a sixth embodiment, the covered region C1 (C1C, C1R, and C1L) and the exposed region B1 (B1D and B1U) of the design surface 3 of the building material of the first embodiment have been changed, and, as illustrated in FIG. 16, the design surface 3 includes, a covered region C6 and an exposed region B6 (B6D, B6U, B6R, and B6L). The other elements of the sixth embodiment are identical to those of the first embodiment. Thus, the elements identical to those of the first embodiment are given identical reference signs, and description thereof is omitted or simplified.

The length of the protective sheet S1 in the up-down direction is set to be equal to the length LV31 of the first design surface 31 in the up-down direction. Thus, the sheet end S1D of the protective sheet S1 does not protrude downward from the first design surface 31. In other words, the second design surface 32D is not covered with the protective sheet S1. In addition, the sheet end S1U of the protective sheet S1 does not protrude upward from the first design surface 31. In other words, the second design surface 32U is not covered with the protective sheet S1.

The length of the protective sheet S1 in the left-right direction is set to be equal to the length LH31 of the first design surface 31 in the left-right direction. Thus, the sheet end S1R of the protective sheet S1 does not protrude rightward from the first design surface 31. In other words, the second design surface 32R is not covered with the protective sheet S1. In addition, the sheet end S1L of the protective sheet S1 does not protrude leftward from the first design surface 31. In other words, the second design surface 32L is not covered with the protective sheet S1.

The covered region C6 is formed on the entire surface of the first design surface 31.

The exposed region B6D is formed on the second design surface 32D. The exposed region B6D extends along the first design end portion 3D. In other words, the exposed region B6D is formed on the surface 22F of the first front-surface-side joining portion 22 on the side of the first face 2F. The exposed region B6U is formed on the second design surface 32U. The exposed region B6U extends along the second design end portion 3U. The exposed region B6R is formed on the second design surface 32R. The exposed region B6R extends along the third design end portion 3R. The exposed region B6L is formed at the second design surface 32L. The exposed region B6L extends along the fourth design end portion 3L.

According to the building material of the sixth embodiment, the exterior wall board 2 to which the protective sheet S1 is affixed is fastened to the structure 8 of a building in the first step in construction (not illustrated). During the step, the covered region C6 of the design surface 3 is protected by the protective sheet S1. After the first step, the protective sheet S1 is peeled off from the design surface 3 in the second step.

The building material is stored and transported as a stacked body. The stacked body has been changed from the stacked body of the first embodiment in terms of only the design surface 3 including the covered region C6 and the exposed region B6.

The exposed region B6U of one of the building materials constituting the set P1 is protected, in a non-contact state, by the protective sheet S1 covering the covered region C6 of another of the building materials constituting the set P1 (not illustrated). Consequently, even when, for example, the exposed region B6U of one of the building materials nearly comes into contact with the design surface 3 of the other of the building materials as a result of the other of the building materials inclining with respect to the one of the building materials during packing or unpacking, the exposed region B6U is protected by the protective sheet S1 of the other of the building materials.

The building material, the stacked body of building materials, and the building-material construction method according to the sixth embodiment having such a configuration are also capable of improving the construction properties while suppressing the design surface 3 from being damaged, similarly to the building material, the stacked body of building materials, and the building-material construction method according to the first to fifth embodiments.

Seventh Embodiment

Figure 17:
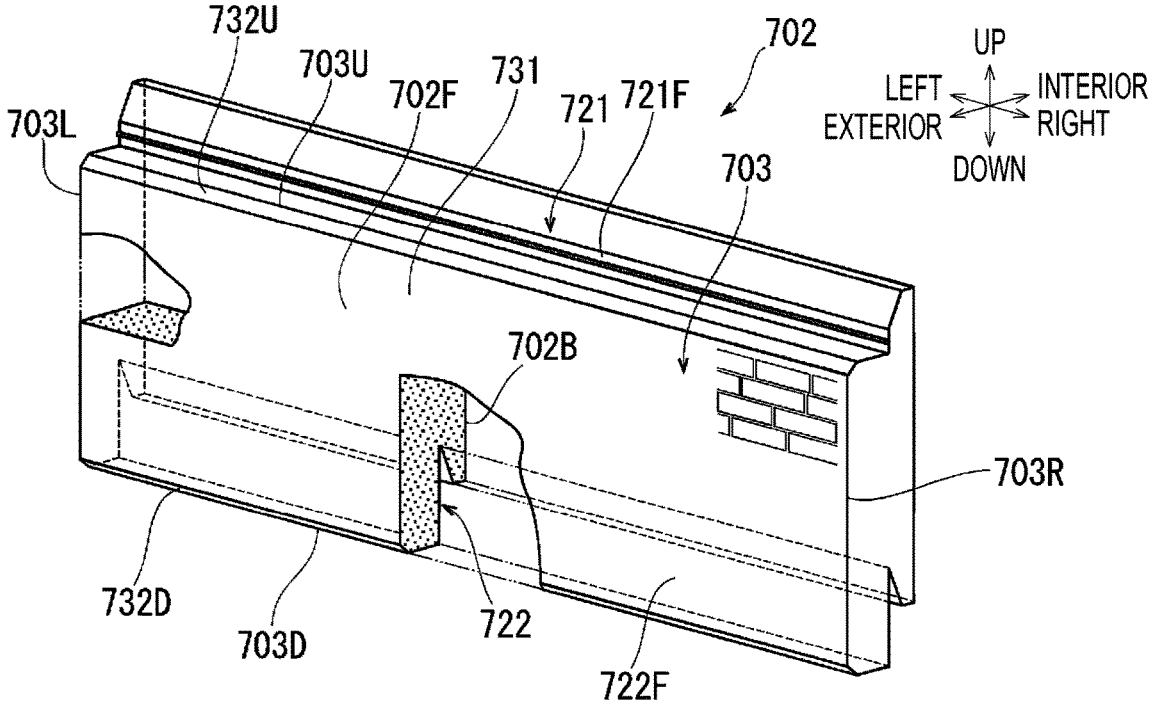
FIG. 17 is a perspective view of the exterior wall board according to a seventh embodiment.

The building material, the stacked body of building materials, and the building-material construction method according to a seventh embodiment employ an exterior wall board 702, illustrated in FIG. 17, as an alternative to the exterior wall board 2 of the building material according to the first embodiment.

Figure 18:
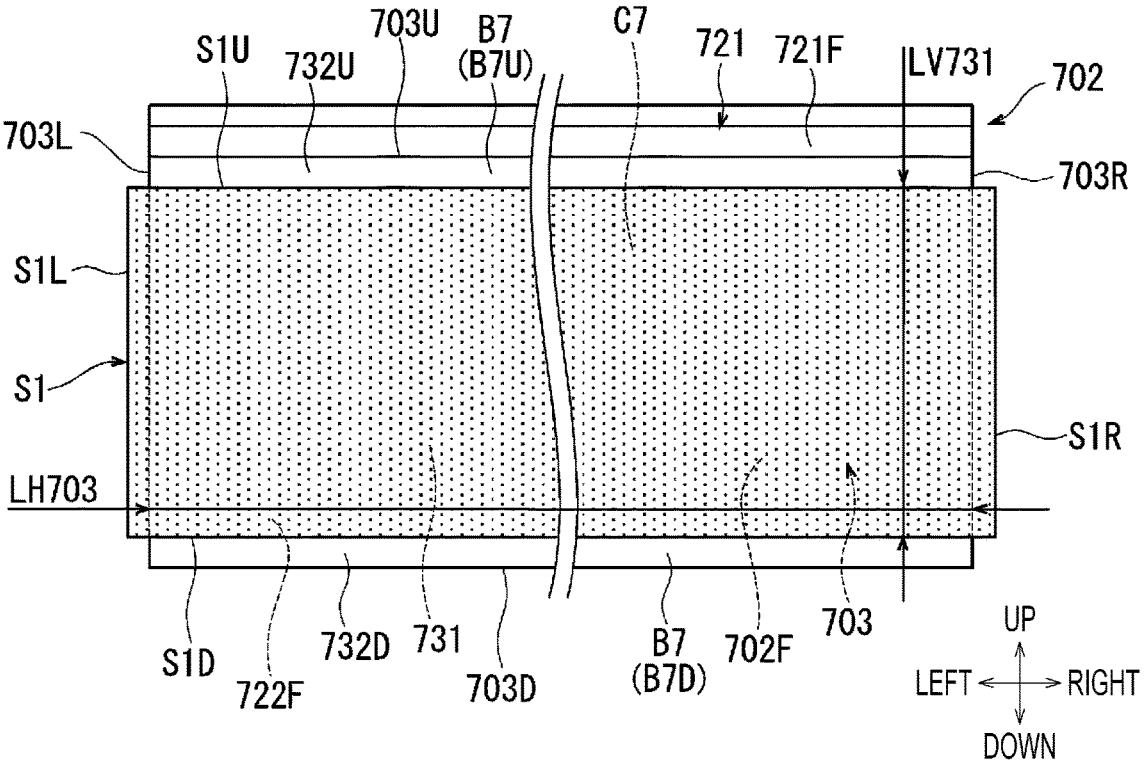
FIG. 18, which relates to the seventh embodiment, is a front view of the exterior wall board to which the protective sheet is affixed.

The exterior wall board 702 is an example of the 'building material body'. As illustrated in FIG. 18, a design surface 703 of the exterior wall board 702 includes a covered region C7 and an exposed region B7 (B7D and B7U). The other elements of the seventh embodiment are identical to those of the first embodiment. Thus, the element identical to those of the first embodiment are given identical reference signs, and description thereof is omitted or simplified.

As illustrated in FIG. 17, in the present embodiment, the exterior wall board 702 is a pulp-mixed cement board. The exterior wall board 702 has a first face 702F and a second face 702B. The first face 702F is a face of the exterior wall board 702 facing the exterior side. The second face 702B is a face of the exterior wall board 702 facing the interior side.

The first face 702F is a surface of the pulp-mixed cement board constituting the exterior wall board 702, the surface having a coated brick pattern with ruggedness. In other words, the design surface 703, which is a rugged surface, is formed on the first face 702F. As an example of the size of the design surface 703, the length in the left-right direction is about 3 m and the length in the up-down direction is about 0.5 m; however, the size of the design surface 703 is not particularly limited.

A first design end portion 703D is a lower end portion of the design surface 703. A second design end portion 703U is an upper end portion of the design surface 703 and is opposite to the first design end portion 703D. The first design end portion 703D and the second design end portion 703U extend parallel to each other in the left-right direction.

A third design end portion 703R is a right end portion of the design surface 703 and is orthogonal to the first design end portion 703D. A fourth design end portion 703L is a left end portion of the design surface 703. The fourth design end portion 703L is orthogonal to the first design end portion 703D and is opposite to the third design end portion 703R. The third design end portion 703R and the fourth design end portion 703L extend parallel to each other in the up-down direction.

A first design surface 731 is spaced inward from each of the first design end portion 703D and the second design end portion 703U and has a rectangular shape. A right end portion of the first design surface 731 is aligned with the third design end portion 703R. A left end portion of the first design surface 731 is aligned with the fourth design end portion 703L.

Second design surfaces 732D and 732U are chamfered portions of upper and lower end portions of the design surface 703. The second design surfaces 732D and 732U connect the upper and lower design end portions and the first design surface 731 to each other and inclines at an angle of approximately 45 degrees with respect to the first design surface 731. The width of each of the second design surfaces 732D and 732U is, for example, about 2.5 mm but not particularly limited.

A first rear-surface-side joining portion 721 is formed at an upper end portion of the exterior wall board 702. The configuration of the first rear-surface-side joining portion 721 is identical to that of the first rear-surface-side joining portion 21 according to the first embodiment, and description thereof is thus omitted. A first front-surface-side joining portion 722 is formed at a lower end portion of the exterior wall board 702, that is, at a portion of the exterior wall board 702 opposite to the first rear-surface-side joining portion 721. The configuration of the first front-surface-side joining portion 722 is identical to that of the first front-surface-side joining portion 22 according to the first embodiment, and description thereof is thus omitted. The exterior wall board 702 has a flat surface at each of left and right end portions.

Figure 19:
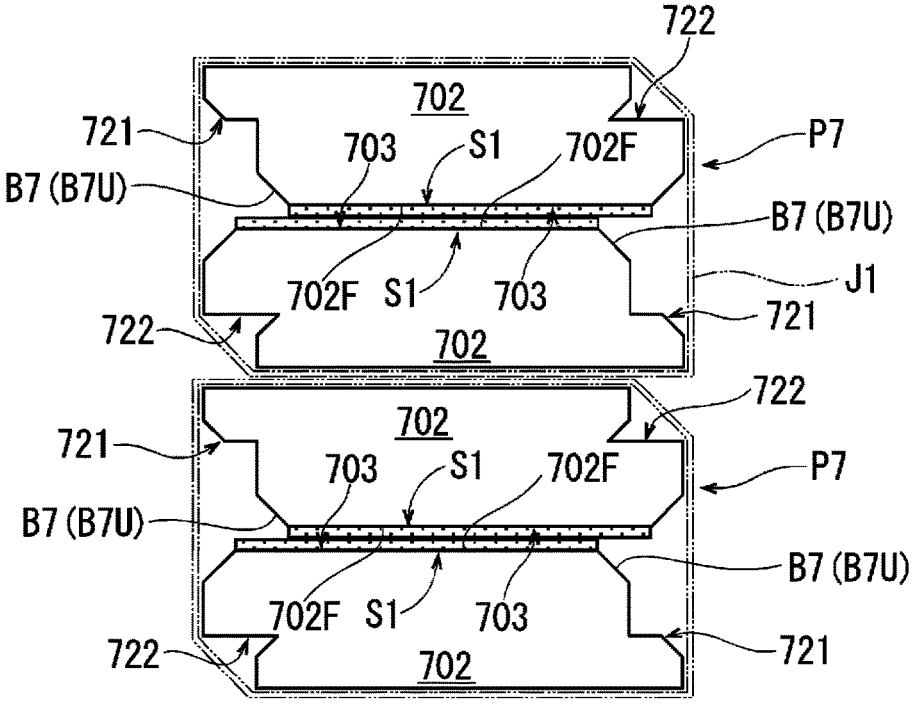
FIG. 19, which relates to the seventh embodiment, is a side view of the stacked body of building materials as viewed in the same direction as that in FIG. 7.

Note that, in FIG. 17 to FIG. 19, each of the second design surfaces 732D and 732U, the first rear-surface-side joining portion 721, and the first front-surface-side joining portion 722 is illustrated such that the size thereof is exaggerated with respect to the size of the exterior wall board 702.

Similarly to the first rear-surface-side joining portion 21 and the first front-surface-side joining portion 22 according to the first embodiment described with reference to FIG. 6, the first rear-surface-side joining portion 721 and the first front-surface-side joining portion 722 are joinable to each other as a result of a pair of the exterior wall boards 702 being vertically adjacent to each other. As a result of the first rear-surface-side joining portion 721 of the exterior wall board 702 on the lower side and the first front-surface-side joining portion 722 of the exterior wall board 702 on the upper side overlapping each other in the interior-exterior direction, an up-down shiplap portion is formed between the exterior wall boards 702 adjacent to each other in the up-down direction.

The protective sheet S1 illustrated in FIG. 18 extends, in a state of being affixed to the first face 702F of the exterior wall board 702, substantially parallel to the first design end portion 703D and the to second design end portion 703U in the left-right direction and extends substantially parallel to the third design end portion 703R and to the fourth design end portion 703L in the up-down direction to cover, in a contact state, the entire surface of the first design surface 731. The length of the protective sheet S1 in the up-down direction is set to be equal to a length LV731 of the first design surface 731 in the up-down direction. Thus, the sheet end S1D of the protective sheet S1 does not protrude downward from the first design surface 731. In other words, the second design surface 732D is not covered with the protective sheet S1. In addition, the sheet end S1U of the protective sheet S1 does not protrude upward from the first design surface 731. In other words, the second design surface 732U and a surface 721F of the first rear-surface-side joining portion 721 on the side of the first face 702F are not covered with the protective sheet S1.

The length of the protective sheet S1 in the left-right direction is set to be greater than a length LH703 of the design surface 703 in the left-right direction. Thus, the sheet end S1R of the protective sheet S1 protrudes rightward from the third design end portion 703R. In addition, the sheet end S1L of the protective sheet S1 protrudes leftward from the fourth design end portion 703L. The distance by which each of the sheet ends S1R and S1L of the protective sheet S1 protrudes rightward or leftward from the design surface 703 is, for example, about 5 mm but not particularly limited.

The covered region C7 is formed on the entire surface of the first design surface 731.

An exposed region B7D is formed on the second design surface 732D. The exposed region B7D extends along the first design end portion 703D. The exposed region B7D is formed on a surface 722F of the first front-surface-side joining portion 722 on the side of the first face 7021. An exposed region B7U is formed on the second design surface 732U. The exposed region B7U extends along the second design end portion 703U.

According to the building material of the seventh embodiment, the exterior wall board 702 to which the protective sheet S1 is affixed is fastened to the structure 8 of a building in the first step in construction (not illustrated). During the step, the covered region C7 of the design surface 703 is protected by the protective sheet S1. After the first step, the protective sheet S1 is peeled off from the design surface 703 in the second step.

As illustrated in FIG. 19, the building material is stored and transported as a stacked body in which the exterior wall boards 702, to each of which the protective sheet S1 is affixed, are stacked on each other.

A pair of the building materials constituting the stacked body forms a set P7 by a procedure identical to that in the first embodiment. In the stacked body of building materials, the first rear-surface-side joining portion 721 of one of the building materials constituting the set P7 is located on a side opposite to the side where the first rear-surface-side joining portion 721 of another of the building materials constituting the set P7 is located. The first front-surface-side joining portion 722 of one of the building materials constituting the set P7 is located on a side opposite to the side where the first front-surface-side joining portion 722 of the other of the building materials constituting the set P7 is located.

The exposed region B7U of one of the building materials constituting the set P7 is protected, in a non-contact state, by the protective sheet S1 covering the covered region C7 of another of the building materials constituting the set P7. Consequently, even when, for example, the exposed region B7U of one of the building materials nearly comes into contact with the design surface 703 of the other of the building materials as a result of the other of the building materials inclining with respect to the one of the building materials during packing or unpacking, the exposed region B7U is protected by the protective sheet S1 of the other of the building materials.

The building material, the stacked body of building materials, and the building-material construction method according to the seventh embodiment having such a configuration also capable of improving the construction properties while suppressing the design surface 703 from being damaged, similarly to the building material, the stacked body of building materials, and the building-material construction method of the first to sixth embodiments.

Eighth Embodiment

Figure 20:
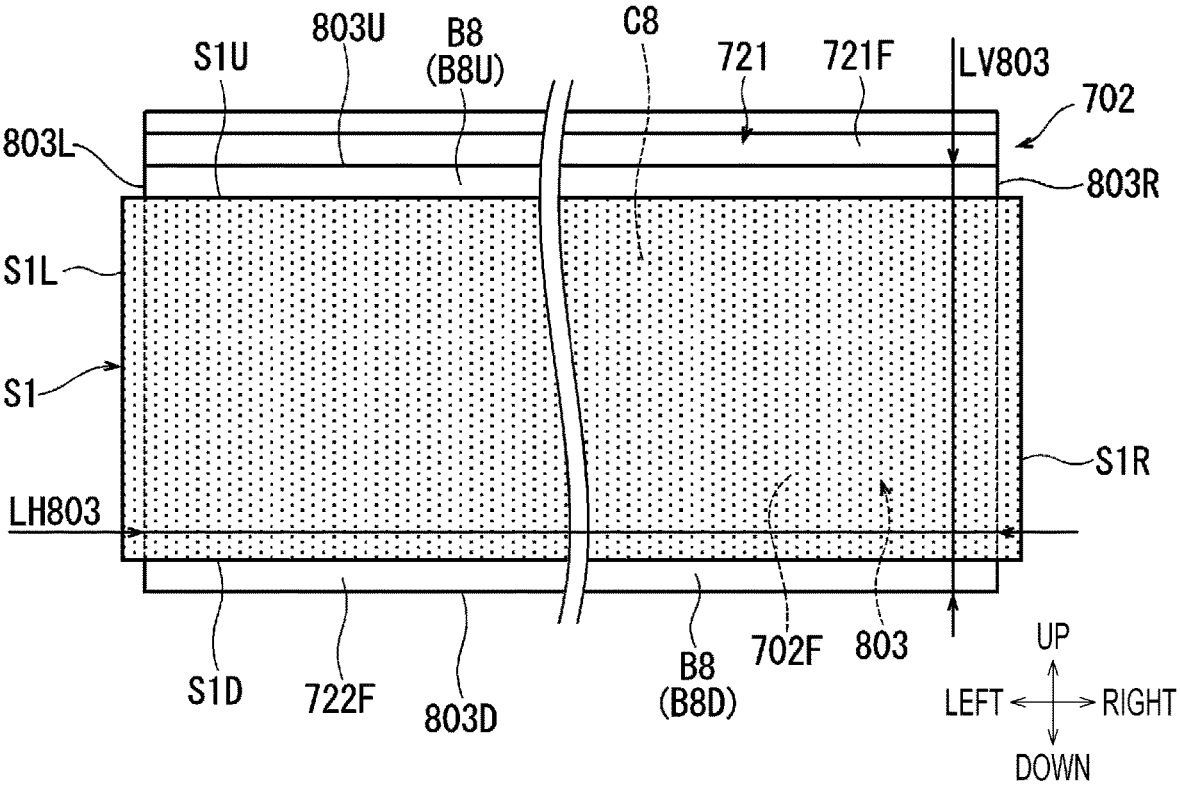
FIG. 20, which relates to an eighth embodiment, is a front view of the exterior wall board to which the protective sheet is affixed.
Figure 21:
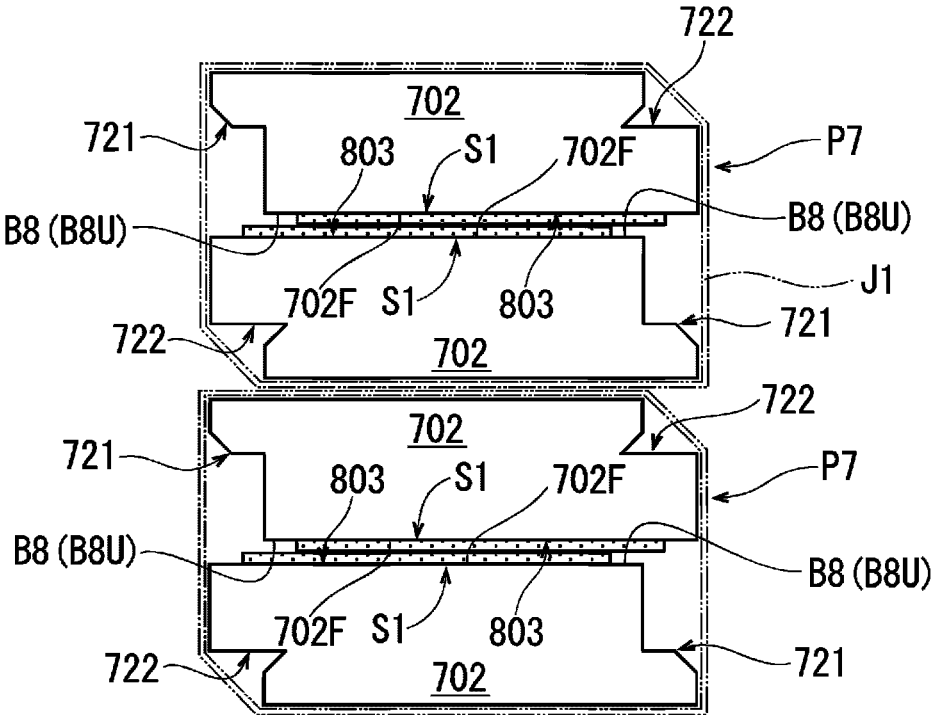
FIG. 21, which relates to the eighth embodiment, is a side view of the stacked body of building materials as viewed in the same direction as that in FIG. 7.

In the building material, the stacked body of building materials, and the building-material construction method according to an eighth embodiment, regarding the exterior wall board 702 of the building material of the seventh embodiment, the design surface 703, illustrated in, for example, FIG. 17, has been changed to a design surface 803, illustrated in FIG. 20 and FIG. 21. As illustrated in FIG. 20, the design surface 803 includes a covered region C8 and an exposed region B8 (B8D and B8U). The other elements of the eighth embodiment are identical to those of the seventh embodiment. Thus, the elements identical to those of the seventh embodiment are given identical reference signs, and description thereof is omitted or simplified.

As illustrated in FIG. 21, the design surface 803 has been subjected to a change in which the chamfered portions formed at the upper and lower end portions are eliminated from the design surface 703, illustrated in, for example, FIG. 17.

A first design end portion 803D is a lower end portion of the design surface 803. A second design end portion 803U is an upper end portion of the design surface 803 and is opposite to the first design end portion 803D. The first design end portion 803D and the second design end portion 803U extend parallel to each other in the left-right direction.

A third design end portion 803R is a right end portion of the design surface 803 and is orthogonal to the first design end portion 803D. A fourth design end portion 803L is a left end portion of the design surface 803. The fourth design end portion 803L is orthogonal to the first design end portion 803D and is opposite to the third design end portion 803R.

The third design end portion 803R and the fourth design end portion 803L extend parallel to each other in the up-down direction.

The length of the protective sheet S1 in the up-down direction is set to be smaller than a length LV803 of the design surface 803 in the up-down direction. The sheet ends S1D and S1U of the protective sheet S1 are spaced inward from upper and lower end portions of the design surface 803, respectively. The distance by which each of the sheet ends S1D and S1U of the protective sheet S1 are respectively spaced from the upper and lower end portions of the design surface 803 is, for example, about 2.0 to 3.0 mm but not particularly limited.

The length of the protective sheet S1 in the left-right direction is set to be greater than a length LH803 of the design surface 803 in the left-right direction. Thus, the sheet end S1R of the protective sheet S1 protrudes rightward from the third design end portion 803R. In addition, the sheet end S1L of the protective sheet S1 protrudes leftward from the fourth design end portion 803L. The distance by which each of the sheet ends S1R and S1L of the protective sheet S1 protrudes rightward or leftward from the design surface 803 is, for example, about 5 mm but not particularly limited.

The covered region C8 is formed on a portion of the design surface 803, the portion being surrounded by the sheet ends S1D and S1U, the third design end portion 803R, and the fourth design end portion 803L.

The exposed regions B8D and B8U are each formed on a portion of the design surface 803, the portion excluding the covered region C8. The exposed region B8D extends along the first design end portion 803D. The exposed region B8D is formed on the surface 722F of the first front-surface-side joining portion 722 on the side of the first face 702F. The exposed region B8U extends along the second design end portion 803U.

According to the building material of the eighth embodiment, the exterior wall board 702 to which the protective sheet S1 is affixed is fastened to the structure 8 of a building in the first step in construction (not illustrated). During the step, the covered region C8 of the design surface 803 is protected by the protective sheet S1. After the first step, the protective sheet S1 is peeled off from the design surface 803 in the second step.

The building material are stored and transported as the stacked body illustrated in FIG. 21. The stacked body has been changed from the stacked body illustrated in FIG. 19 in terms of only the design surface 803 having no chamfered portion and including the covered region C8 and the exposed region B8.

As illustrated in FIG. 21, the exposed region B8U of one of the building materials constituting the set P7 is protected by the protective sheet S1 covering the covered region C8 of another of the building materials constituting the set P7. More specifically, the exposed region B8U and the protective sheet S1 of the other of the building materials are opposite each other with a small gap therebetween, the gap being formed by the thickness of the protective sheet S1 of the one of the building materials. Consequently, even when, for example, the exposed region B8U of one of the building materials nearly comes into contact with the design surface 803 of the other of the building materials during packing, storage, transport, unpacking, or the like, the exposed region B8U is protected by the protective sheet S1 of the other of the building materials.

Embodiments of the present invention have been described above on the basis of the first to eighth embodiments; however, the embodiments of the present invention are not limited to the aforementioned first to eighth embodiments, and it is needless to say that the aforementioned first to eighth embodiments are applicable with appropriate modification applied thereto within the spirit of the present invention.

For example, the design surface may not be formed on the entirety of the first face. The front surface facing the exterior side may be the first face. The rear surface facing the interior side may be the first face. Both the front surface and the rear surface may be the first face. The design surface may be a rugged surface or may be a flat surface.

REFERENCE SIGNS LIST

2, 702 building material body (exterior wall board)
S1 protective sheet
S1D, S1U, S1R, S1L sheet end
2F, 702F first face
2B, 702B second face
3, 703, 803 design surface
3D, 703D, 803D first design end portion
3U, 703U, 803U second design end portion
3R, 703R, 803R third design end portion
3L, 703L, 803L fourth design end portion
C1, C2, C3, C4, C5, C6, C7, C8 covered region
B1, B2, B3, B4, B5, B6, B7, B8 exposed region
31, 731 first design surface
32D, 32U, 32R, 32L, 732D, 732U second design surface
21, 721 first rear-surface-side joining portion
22, 722 first front-surface-side joining portion
21F, 721F surface of first rear-surface-side joining portion on the side of first face
22F, 722F surface of first front-surface-side joining portion on the side of first face
23 second rear-surface-side joining portion
24 second front-surface-side joining portion
P1, P7 set of building materials (exterior wall boards)
8 structure

The invention claimed is:

1. A building material comprising:

a first face;

a second face that faces a side opposite to a side that the first face faces;

a substantially rectangular plate-shaped building material body that includes the first face and a design surface formed within the first face; and a protective sheet peelably affixed to the design surface, wherein the design surface includes a covered region that is covered with the protective sheet and thereby protected, an exposed region that is not covered with the protective sheet, the exposed region comprising at least first and second exposed regions, a main design surface which is a flat surface having a first inner-edge, a second inner-edge, a third inner-edge and a fourth inner-edge, the first inner-edge and the second inner-edge opposing each other, and the third inner-edge and the fourth inner-edge opposing each other, a first incline surface inclined in a direction between the first face and the second face and downwardly extends from the first inner-edge, which is one end of the main design surface, to a first design end portion, which is an outer edge of the design surface, and a second incline surface inclined in the direction between the first face and the second face and downwardly extends from the second inner-edge, which is another end of the main design surface, to a second design end portion, which is another outer edge of the design surface formed at an opposite side of the first design end portion, wherein the main design surface includes the first and the second exposed regions and the covered region, the covered region having a first and a second opposite edge, the first exposed region extending between the first edge of the first exposed region and the first inner-edge, and the second exposed region extending between the second edge of the second exposed region and the second inner-edge, wherein the covered region between the first exposed region and the second exposed region on the main design surface, and wherein when a pair of the building materials are stacked in such a manner that one of the first faces abuts on another of the first faces, the exposed regions are formed so as to be individually protected by the corresponding other protective sheets.

2. A stacked body of building materials, each of the building materials being the building material according to claim 1, the building materials being stacked on each other, wherein a pair of the building materials that are stacked on each other in a state in which the first faces of the building materials are opposite each other constitutes a set, and wherein the exposed region of one of the building materials constituting the set is protected by the protective sheet that covers the covered region of another of the building materials constituting the set.

3. A building-material construction method comprising:

a first step for fastening the building material according to claim 1 to a structure of a building; and a second step for peeling the protective sheet from the design surface after the first step.

4. The building material according to claim 1, comprising a first end extending between the first and second faces and having a tongue extending therefrom, and an opposite second end extending between the first and second faces and having a groove therein for receiving the tongue of another building material.

5. The building material according to claim 1, comprising a third end extending between the first and second faces and having a tongue extending therefrom, and an opposite fourth end extending between the first and second faces and having a groove therein for receiving the tongue of the third end of another building material.

6. The building material according to claim 1, wherein the main design surface further includes a third exposed region, and the covered region further has a third edge, the third exposed region extending between the third edge of the exposed region and the third inner-edge.

7. The building material according to claim 1, wherein the main design surface further includes a third exposed region and a fourth exposed region, and the covered region further has a third and a fourth opposite edge, the third exposed region extending between the third edge of the third exposed region and the third inner-edge, and the fourth exposed region extending between the fourth edge of the fourth exposed region and the fourth inner-edge.

* * * * *